US011508280B2

(12) United States Patent
Ichikura

(10) Patent No.: US 11,508,280 B2
(45) Date of Patent: Nov. 22, 2022

(54) DISPLAY DEVICE, DISPLAY DRIVER, AND FAILURE INSPECTION METHOD

(71) Applicant: LAPIS Technology Co., Ltd., Yokohama (JP)

(72) Inventor: Hiroyoshi Ichikura, Yokohama (JP)

(73) Assignee: LAPIS TECHNOLOGY CO., LTD., Yokohama (JP)

( * ) Notice: Subject to any disclaimer, the term of this patent is extended or adjusted under 35 U.S.C. 154(b) by 0 days.

(21) Appl. No.: 17/694,487

(22) Filed: Mar. 14, 2022

(65) Prior Publication Data

US 2022/0319375 A1 Oct. 6, 2022

(30) Foreign Application Priority Data

Mar. 30, 2021 (JP) ..... JP2021-056891

(51) Int. Cl.
*G09G 3/20* (2006.01)

(52) U.S. Cl.
CPC ..... *G09G 3/20* (2013.01); *G09G 2310/0291* (2013.01); *G09G 2330/12* (2013.01)

(58) Field of Classification Search
CPC ..... G09G 3/20; G09G 2310/0291; G09G 2330/12
See application file for complete search history.

(56) References Cited

U.S. PATENT DOCUMENTS

2018/0114350 A1* 4/2018 Uchidate ..... H04N 7/08
2018/0115151 A1* 4/2018 Cao ..... G09G 3/36

FOREIGN PATENT DOCUMENTS

WO 2018/079636 A1 5/2018

* cited by examiner

*Primary Examiner* — Sejoon Ahn
(74) *Attorney, Agent, or Firm* — Rabin & Berdo, P.C.

(57) ABSTRACT

An operational amplifier has a first input terminal and an output terminal connected to a second input terminal of the operational amplifier, and output nodes connected to the source lines of a display panel. During a failure inspection mode, the connection between the output node and the output terminal of the operational amplifier included in another output circuit among one output circuit and the other output circuit is disconnected and the output node instead of the output terminal is connected to the second input terminal of the operational amplifier. A pair of source lines connected to the output nodes of the one output circuit and the other output circuit are linked to each other, and signals attained by acquiring and binarizing voltages outputted from the operational amplifier in the other output circuit as a monitor voltage at different timings are acquired as first and second failure determination signals.

14 Claims, 20 Drawing Sheets

DISPLAY DEVICE, DISPLAY DRIVER, AND FAILURE INSPECTION METHOD

CROSS REFERENCE TO RELATED APPLICATION

This application is based upon and claims the benefit of priority of the prior Japanese Patent Application No. 2021-056891, filed on Mar. 30, 2021, the entire contents of which are incorporated herein by reference.

TECHNICAL FIELD

The present invention relates to a display device that displays an image according to an image signal, a display driver, and a failure inspection method.

BACKGROUND ART

In recent years, vehicles have been developed in which display panels such as liquid crystal display panels and organic EL (electroluminescence) display panels are used not only for car navigation systems but also to display various instruments. In this case, if there is a failure in the display panel used for the various instruments that results in erroneous display while the vehicle is in motion, this can pose the risk of impediments to driving.

In order to handle this issue, a liquid crystal display device that includes a failure inspection circuit that performs an inspection on the display panel during operation to determine whether or not a failure has occurred, and issues a warning to occupants of the vehicle when a failure is detected has been proposed (e.g., see WO/2018/079636).

The failure inspection circuit supplies a monitor input signal from a first end of each of a plurality of source lines of the liquid crystal display panel and compares a monitor output signal outputted from the second end of each of the source lines to a prescribed expected value to detect a short-circuit anomaly or an open-circuit anomaly in each source line. Thus, the failure inspection circuit includes monitor signal lines for inputting a monitor input signal for failure inspection, and that are connected individually to the first end of each source line, and a comparison circuit that compares the monitor output signal outputted from the second end of each source line to the prescribed expected value.

SUMMARY OF THE INVENTION

Thus, in order to achieve the failure inspection disclosed in WO/2018/079636, it is necessary to provide a comparison circuit for comparing the monitor output signal to the expected value within the source driver, which poses the issue of increased cost and device size. Additionally, with the failure inspection disclosed in WO/2018/079636, a failure is determined to have occurred by performing a size comparison using the expected value as a threshold, and thus, it has been difficult to accurately detect failures such as minute current leaks.

An object of the present invention is to provide a display device, a display driver, and a failure inspection method by which it is possible to accurately detect failures occurring in the display panel while mitigating an increase in device size.

A display device according to the present invention includes: a display panel that includes first to nth (n being an integer of 2 or greater) source lines, a linking line, and first to nth source line linking switches that are each connected to respective first ends of the first to nth source lines and that connect the first ends to the linking line when turned ON; a decoder unit that generates first to nth drive voltages having a voltage value based on an image signal during a normal mode, and generates n voltages having a test voltage as the first to nth drive voltages during a failure inspection mode; first to nth output circuits that each include an operational amplifier that is configured to receive the drive voltage via a first input terminal and that has an output terminal connected to a second input terminal, and an output node connected to a second end of each of the source lines, the first to nth output circuits being configured to output, via the respective output nodes thereof, voltages attained by individually amplifying the first to nth drive voltages in the operational amplifier as first to nth output voltages; a failure inspection control unit that, during the failure inspection mode, sets a source line linking switch, among the first to nth source line linking switches, that is connected to one source line and another source line among the first to nth source lines so as to be ON while setting OFF other source line linking switches, disconnects a connection between the output node and the output terminal of the operational amplifier included in another one of the output circuits connected to said another source line among one of the output circuits connected to the one source line and said another one of the output circuits, and connects the output node instead of the output terminal to the second input terminal of the operational amplifier; and a failure determination circuit that is configured to set a voltage of the output terminal of the operational amplifier included in said another one of the output circuits as a monitor voltage, to store, as a first failure determination signal, a signal attained by acquiring and binarizing the monitor voltage at a first timing, and to store, as a second failure determination signal, a signal attained by acquiring and binarizing the monitor voltage at a second timing delayed from the first timing by a prescribed delay time.

Also, a display device according to the present invention includes: a display panel including first to nth (n being an integer of 2 or greater) source lines; a decoder unit that generates first to nth drive voltages having a voltage value based on an image signal during a normal mode, and generates n voltages having a test voltage as the first to nth drive voltages during a failure inspection mode; first to nth output circuits that each include an operational amplifier that is configured to receive the drive voltage via a first input terminal and that has an output terminal connected to a second input terminal, and an output node connected to each of the source lines, the first to nth output circuits being configured to output, via the respective output nodes thereof, voltages attained by individually amplifying the first to nth drive voltages in the operational amplifier as first to nth output voltages; a failure inspection control unit that, during the failure inspection mode, disconnects a connection between the output node and the output terminal of the operational amplifier included in another one of the output circuits among one of the output circuits connected to one source line among the first to nth source lines and said another one of the output circuits connected to another source line, and connects the output node included in said one of the output circuits, instead of the output terminal, to the second input terminal of the operational amplifier; and a failure determination circuit that is configured to set a voltage of the output terminal of the operational amplifier included in said another one of the output circuits as a monitor voltage, to store, as a first failure determination signal, a signal attained by acquiring and binarizing the monitor voltage at a first timing, and to store, as a second failure determination signal, a signal attained by acquiring and binarizing the monitor voltage at a second timing delayed from the first timing by a prescribed delay time.

A display driver according to the present invention includes: a decoder unit that generates first to nth (n being an integer of 2 or greater) drive voltages having a voltage value based on an image signal during a normal mode, and that generates n voltages having a test voltage as the first to nth drive voltages during a failure inspection mode; first to nth output circuits that each include an operational amplifier that is configured to receive the drive voltage via a first input terminal and that has an output terminal connected to a second input terminal, and an output node connected to an external terminal, the first to nth output circuits being configured to output, from n of the external terminals, voltages attained by individually amplifying the first to nth drive voltages in the operational amplifier as first to nth output voltages; a failure inspection control unit that, during the failure inspection mode, disconnects a connection between the output node and the output terminal of the operational amplifier included in another one of the output circuits among one of the output circuits connected to one external terminal among the n external terminals and said another one of the output circuits connected to another external terminal, and connects the output node included in said one of the output circuits, instead of the output terminal, to the second input terminal of the operational amplifier; and a failure determination circuit that is configured to set a voltage of the output terminal of the operational amplifier included in said another one of the output circuits as a monitor voltage, to store, as a first failure determination signal, a signal attained by acquiring and binarizing the monitor voltage at a first timing, and to store, as a second failure determination signal, a signal attained by acquiring and binarizing the monitor voltage at a second timing delayed from the first timing by a prescribed delay time.

A failure inspection method according to the present invention is a failure inspection method for a display panel in a display device including: a display panel that includes first to nth (n being an integer of 2 or greater) source lines, a linking line, and first to nth source line linking switches that are each connected to respective second ends of the first to nth source lines and that connect the second ends to the linking line when turned ON; first to nth output circuits that each include an operational amplifier that is configured to receive, at a first input terminal thereof, a drive voltage having a voltage value based on an image signal or a test voltage value for failure inspection, and an output node connected to the source line, the first to nth output circuits being configured to supply an output voltage outputted from the operational amplifier to the source line via the output node, wherein the failure inspection method includes: connecting an output terminal of the operational amplifier included in one output circuit among the first to nth output circuits to the output node and connecting a second input terminal of the operational amplifier to the output node; disconnecting a connection between the output node and the output terminal of the operational amplifier included in another one of the output circuits differing from the one output circuit among the first to nth output circuits, and connecting the output node instead of the output terminal to the second input terminal of the operational amplifier; setting the source line linking switch, among the first to nth source line linking switches, connected to each of a pair of the source lines connected to the output node of the one output circuit and said another one of the output circuits so as to be ON, and setting other source line linking switches to be OFF; and setting a voltage of the output terminal of the operational amplifier included in said another one of the output circuits as a monitor voltage and storing, as a first failure determination signal, a signal attained by acquiring and binarizing the monitor voltage at a first timing, and storing, as a second failure determination signal, a signal attained by acquiring and binarizing the monitor voltage at a second timing delayed from the first timing by a prescribed delay time.

Also, a failure inspection method according to the present invention is a failure inspection method for a display panel in a display device including: a display panel including first to nth (n being an integer of 2 or greater) source lines; first to nth output circuits that each include an operational amplifier that is configured to receive, at a first input terminal thereof, a drive voltage having a voltage value based on an image signal or a test voltage value for failure inspection, and an output node connected to the source line, the first to nth output circuits being configured to supply an output voltage outputted from the operational amplifier to the source line via the output node, wherein the failure inspection method includes: connecting an output terminal of the operational amplifier included in one output circuit among the first to nth output circuits to the output node and connecting a second input terminal of the operational amplifier to the output node; disconnecting a connection between the output node and the output terminal of the operational amplifier included in another one of the output circuits differing from the one output circuit among the first to nth output circuits, and connecting the output node of the first output circuit to the second input terminal of the operational amplifier; and setting a voltage of the output terminal of the operational amplifier included in said another one of the output circuits as a monitor voltage and storing, as a first failure determination signal, a signal attained by acquiring and binarizing the monitor voltage at a first timing, and storing, as a second failure determination signal, a signal attained by acquiring and binarizing the monitor voltage at a second timing delayed from the first timing by a prescribed delay time.

In the present invention, failure inspection is performed using a plurality of operational amplifiers, which supply the output voltage generated by amplifying the drive voltage based on the image signal to the plurality of source lines of the display panel. In other words, the test voltage for failure inspection is supplied by one operational amplifier to the source lines, and the monitor voltage is acquired as test results by another operational amplifier. By acquiring the monitor voltages at respectively different timings and binarizing the monitor voltages it is possible to attain the failure determination signals that enable determination of the failure state.

As a result, it is possible to perform failure inspection for each of the source lines without providing an input circuit specifically for supplying a test voltage for failure inspection to the source lines or a comparison circuit for comparing the output result based on the test voltage to an expected value.

Additionally, in the present invention, failure determination is performed by acquiring monitor voltages (output results) attained by supplying the test voltage to the source lines at different timings and binarizing the monitor voltages. As a result, it is possible to accurately detect not only disconnection failures and short-circuit failures but also minute current leakage failures.

Thus, according to the present invention, it is possible to accurately detect failures occurring in the display panel while mitigating an increase in device size.

DETAILED DESCRIPTION OF EMBODIMENTS

Embodiments of the present invention will be explained in detail below with reference to the drawings.

Embodiment 1

Figure 1:
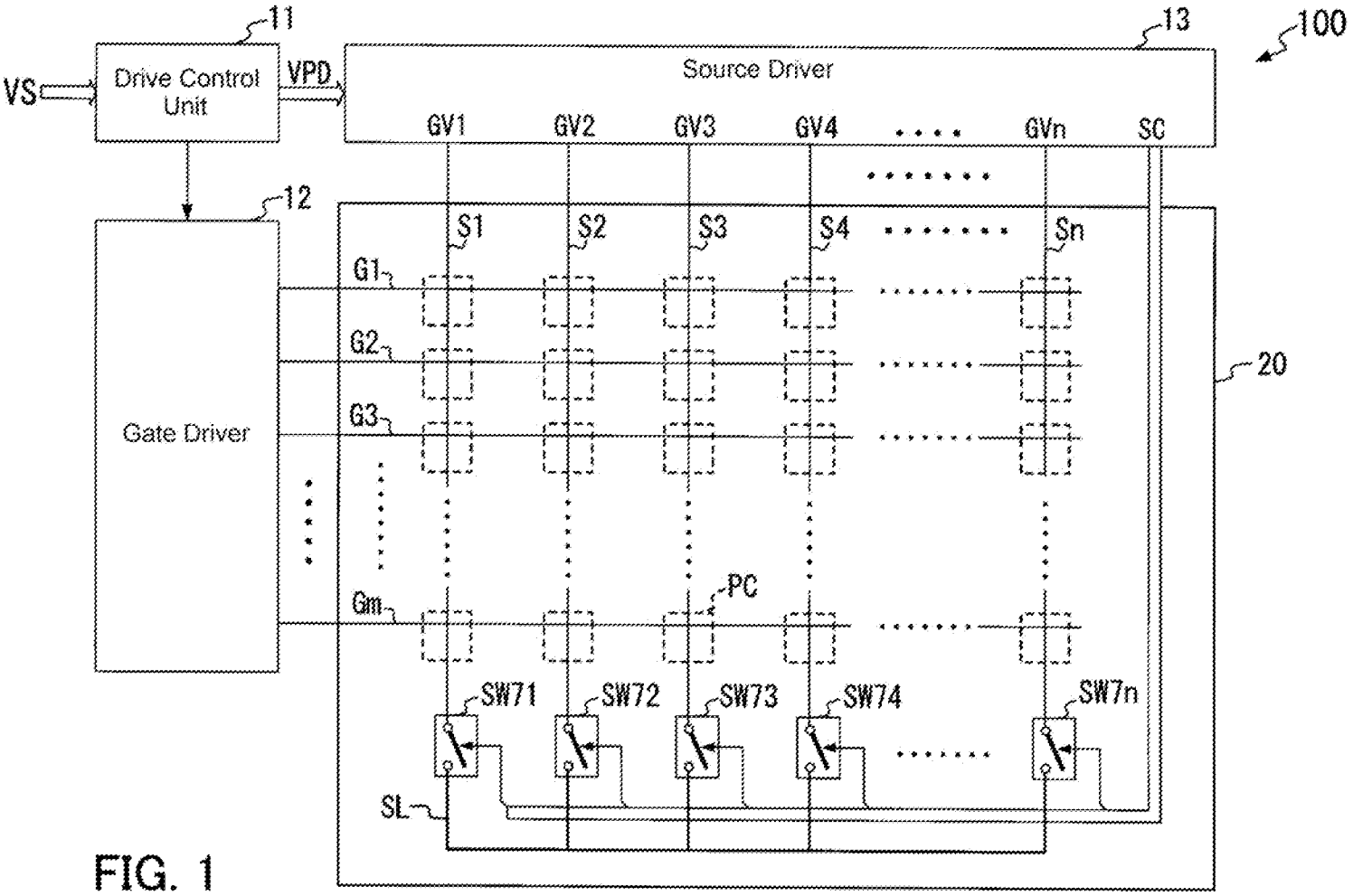
FIG. 1 is a block diagram showing a configuration of a display device 100 according to Embodiment 1.

FIG. 1 is a block diagram showing a configuration of a display device 100 according to Embodiment 1 of the present invention.

The display device 100 has a drive control unit 11, a gate driver 12, a source driver 13, and a capacitive display panel 20.

The display device 20 has disposed therein gate lines G1 to Gm (m being an integer of 2 or greater) that each extend in the horizontal direction on a 2-dimensional screen, and source lines S1 to Sn (n being an integer of 2 or greater) that each extend in the vertical direction on the 2-dimensional screen, the gate lines and the source lines intersecting each other. Each intersection point between the gate line and the source line has formed therein a display cell PC as a liquid crystal element or an organic EL element, for example.

Additionally, the display panel 20 has disposed therein source line linking switches SW71 to SW7*n* that are connected respectively to the first end of each of the source lines S1 to Sn, and a single linking line SL. The source line linking switches SW71 to SW7*n* are set ON or OFF individually according to n linking control signals SC corresponding to the respective switches. When each of the source line linking switches SW71 to SW7*n* is set to be ON, the second end of the corresponding source line is connected to the linking line SL, whereas when each of the source line linking switches SW71 to SW7*n* is set to be OFF, the second end of the source line is set to an open state. As a result, by setting at least two of the source line linking switches SW71 to SW7*n* to the ON state, the second ends of the source lines connected to the at least two switches are shorted through the linking line SL.

The drive control unit 11 receives the image signal VS, generates a scanning signal according to a horizontal synchronizing signal included in the image signal VS, and supplies the scanning signal to the gate driver 12. Additionally, the drive control unit 11 generates, on the basis of the image signal VS, an image data signal VPD including various control signals including an acquisition timing signal and a sequence of display data pieces that represents the luminance level of each pixel in 8 bits, for example, and supplies the image data signal VPD to the source driver 13.

The drive control unit 11 is set to failure inspection mode when the power is turned ON or during the vertical blanking period, and is set to normal mode during other periods. In other words, the drive control unit 11 supplies the image data signal VPD including the sequence of display data pieces based on the image signal VS to the source driver 13 as described above when set in the normal mode.

On the other hand, when set in the failure inspection mode, the drive control unit 11 supplies, to the source driver 13, an image data signal VPD including a sequence of test data pieces (e.g., 8 bits) for failure inspection corresponding to each of the source lines S1 to Sn instead of the above-mentioned sequence of display data pieces.

The gate driver 12 generates a scanning pulse according to the scanning signal supplied from the drive control unit 11 and applies the scanning pulse sequentially and alternately to each of the gate lines G1 to Gn of the display panel 20.

The source driver 13 acquires the image data signal VPD, and generates n output voltages GV1 to GVn for each horizontal scanning period on the basis of the image data signal VPD, and supplies each of the output voltages GV1 to GVn to the source lines S1 to Sn of the display panel 20.

Figure 2:
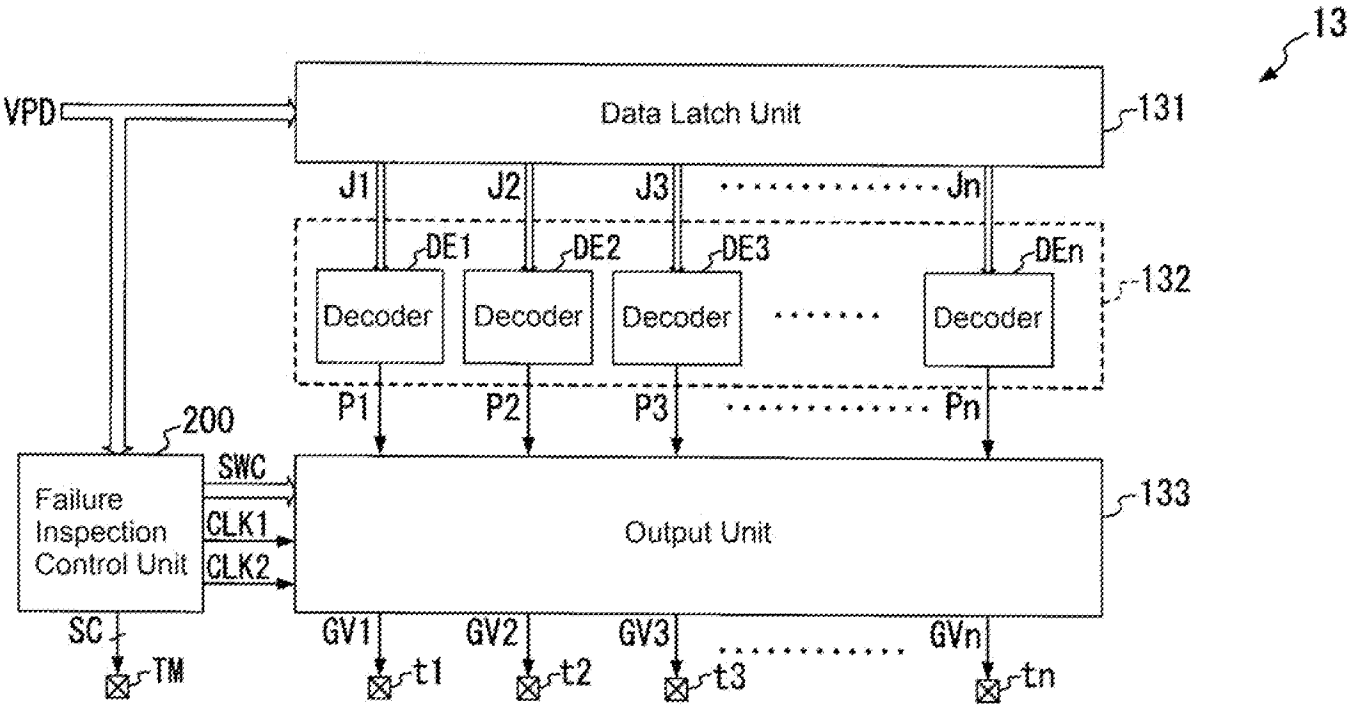
FIG. 2 is a block diagram showing an example of an internal configuration of a source driver 13.

FIG. 2 is a block diagram showing an example of an internal configuration of a source driver 13.

As shown in FIG. 2, the source driver 13 includes a data latch unit 131, a decoder unit 132, an output unit 133, and a failure inspection control unit 200.

The data latch unit 131 acquires the sequence of display data pieces (or test data pieces) included in the image data signal VPD. Upon acquiring n display data pieces (or test data pieces) for each horizontal scanning period, the data latch unit 131 supplies each of the display data pieces to the decoder unit 132 as the display data J1 to Jn.

The decoder unit 132 includes n decoders DE1 to DEn corresponding to each of the pieces of display data J1 to Jn. Each of the decoders DE1 to DEn selects a voltage corresponding to the value indicated by the display data Jr (r being an integer of 1 to n) received thereby from among a plurality of gradation voltages having different voltage values, and supplies the selected gradation voltage to the output unit 133 as the drive voltage Pr. As a result, the decoders DE1 to DEn convert the respective pieces of display data J1 to Jn received thereby to drive voltages P1 to Pn having analog voltage values, and supply the drive voltages P1 to Pn to the output unit 133.

That is, the decoder unit 132 supplies to the output unit 133 the drive voltages P1 to Pn having voltage values corresponding to the luminance levels of the respective pixels based on the image signal VS during normal mode. On the other hand, during failure inspection mode, the decoder unit 132 supplies to the output unit 133 the drive voltages P1 to Pn having test voltage values based on the test data pieces.

The output unit 133 is set to normal mode or failure inspection mode according to failure inspection control data SWC and acquisition timing signals CLK1 and CLK2 supplied from the failure inspection control unit 200.

During the normal mode, the output unit 133 generates, as the output voltages GV1 to GVn, the n voltages attained by individually amplifying the drive voltages P1 to Pn, and supplies the n voltages to the source lines S1 to Sn of the display panel 20 via external terminals t1 to tn of the source driver 13. On the other hand, during the failure inspection mode, the output unit 133 receives the drive voltages P1 to Pn as test voltages and supplies the test voltages to the source lines S1 to Sn of the display panel 20 to perform failure inspection for detecting a failure such as a short-circuit between source lines, a disconnection or current leakage in the source lines, or the like.

When the power is turned ON or during the vertical blanking period of the image data signal VPD, the failure inspection control unit 200 supplies the failure inspection control data SWC for setting the failure inspection mode and the acquisition timing signals CLK1 and CLK2 to the output unit 133. The acquisition timing signals CLK1 and CLK2 have different phases from each other. The timing of the front edge of the acquisition timing signal CLK1 is ahead of the timing of the front edge of the acquisition timing signal CLK2, for example. Additionally, when the power is turned ON or during the vertical blanking period of the image data signal VPD, the failure inspection control unit 200 supplies, to the display panel 20 via the external terminal TM, a linking control signal SC for sequentially and selectively setting each pair of the source line linking switches SW71 to SW7*n* to be ON.

Also, during periods other than when the power is turned ON or the vertical blanking period of the image data signal VPD, the failure inspection control unit 200 supplies the failure inspection control data SWC for setting the normal mode to the output unit 133. Additionally, during periods other than when the power is turned ON or during the vertical blanking period of the image data signal VPD, the failure inspection control unit 200 supplies, to the display panel 20 via the external terminal TM, a linking control signal SC for setting all of the source line linking switches SW71 to SW7*n* to be OFF.

Figure 3:
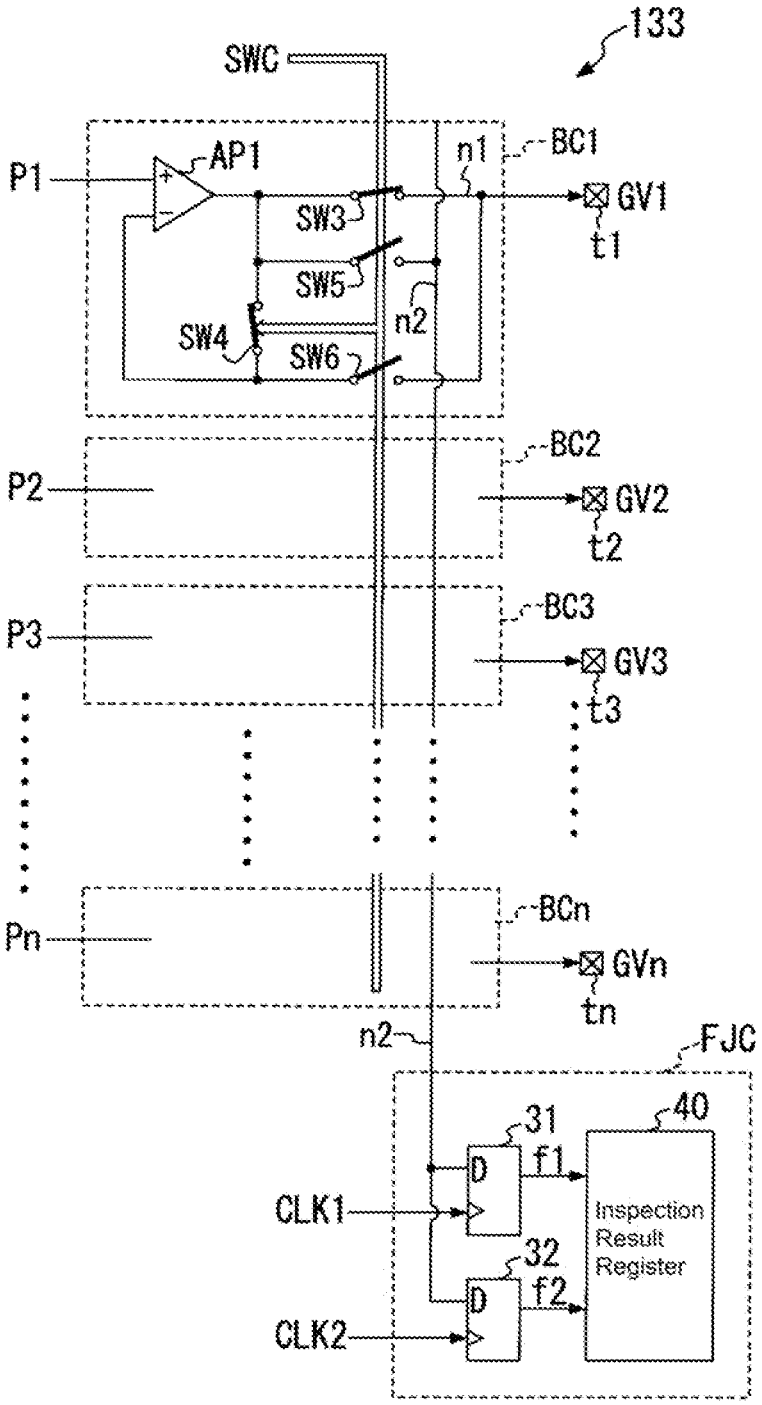
FIG. 3 is a circuit diagram showing an example of an internal configuration of an output unit 133.

FIG. 3 is a circuit diagram showing the internal configuration of the output unit 133.

As shown in FIG. 3, the output unit 133 includes output circuits BC1 to BCn that respectively receive the drive voltages P1 to Pn, and a failure determination circuit FJC. The output circuits BC1 to BCn have the same internal configuration. Thus, the internal configuration of only the output circuit BC1 will be described below.

The output circuit BC1 includes an operational amplifier AP1 as an output amplifier, and switches SW3 to SW5 that are individually set to be ON or OFF according to the failure inspection control data SWC. The operational amplifier AP1 receives the drive voltage P1 at the non-inversion input terminal as a first input terminal, for example. The output terminal of the operational amplifier AP1 is connected to an output node n1 via the switch SW3 and is connected to the inversion input terminal as the second input terminal of the operational amplifier AP1 via the switch SW4.

When the switch SW3 is set to be ON, the output terminal of the operational amplifier AP1 is connected to the output node n1, whereas when the switch SW3 is set to be OFF, the output terminal of the operational amplifier AP1 and the output node n1 are disconnected from each other. When the switch SW4 is set to be ON, the output terminal of the operational amplifier AP1 is connected to the inversion input terminal of the operational amplifier AP1, whereas when the switch SW4 is set to be OFF, the output terminal of the operational amplifier AP1 and the inversion input terminal are disconnected from each other. When the switch SW5 is set to be ON, the output terminal of the operational amplifier AP1 is connected to the failure determination circuit FJC via a monitor node n2, whereas when the switch SW5 is set to be OFF, the output terminal of the operational amplifier AP1 and the monitor node n2 are disconnected from each other. When the switch SW6 is set to be ON, the output node n1 is connected to the inversion input terminal of the operational amplifier AP1, whereas when the switch SW6 is set to be OFF, the inversion input terminal of the operational amplifier AP1 and the output node n1 are disconnected from each other.

The switches SW3 and SW5 are complementarily set to the ON state and the OFF state. Thus, the switches SW3 and SW5 selectively connect the output terminal of the operational amplifier AP1 to the output node n1 or the monitor node n2 on the basis of the failure inspection control data SWC. The switches SW4 and SW6 are also complementarily set to the ON state and the OFF state. Thus, the switches SW4 and SW6 selectively connect the inversion input terminal of the operational amplifier AP1 to the output terminal thereof or the output node n1.

Thus, the switches SW3 to SW6 function as connection switching units that selectively connect the output terminal of the operational amplifier AP1 to the output node n1 or the monitor node n2 and selectively connect the inversion input terminal of the operational amplifier AP1 to the output terminal thereof or the output node n1.

FIG. 3 shows the state of the switches SW3 to SW6 when the failure inspection control data SWC for setting the normal mode is supplied from the failure inspection control unit 200. That is, the switches SW3 and SW4 of the output circuits BC1 to BCn are set to the ON state and the switches SW5 and SW6 are set to the OFF state according to the failure inspection control data SWC for setting the normal mode. Thus, during the normal mode, the operational amplifier AP1 of each of the output circuits BC1 to BCn is a so-called voltage follower in which the output terminal thereof is connected to the inversion input terminal. As a result, the operational amplifier AP1 of the output circuit BC1 outputs, via the output node n1, the output voltage GV1 having a voltage value corresponding to the drive voltage P1 received by the non-inversion input terminal.

The failure determination circuit FJC includes flip-flops 31 and 32 (hereinafter referred to as FFs), and an inspection result register 40.

The FFs 31 and 32 receive, at the respective D terminals thereof via the monitor node n2, the voltage outputted from the operational amplifier AP1 of one of the output circuits BC1 to BCn. The voltage received by the D terminal of each of the FFs 31 and 32 via the monitor node n2 is hereinafter referred to as the monitor voltage.

The FF 31 takes in the monitor voltage received at the D terminal at the timing of the front edge of the acquisition timing signal CLK1. At this time, the FF 31 retains a binary signal with a logic level of 1 if the voltage value of the taken in monitor voltage is greater than or equal to a prescribed threshold and a logic level of 0 if the monitor voltage is less than the prescribed threshold, and supplies the binary signal to the inspection result register 40 as a failure determination signal f1.

The FF 32 takes in the monitor voltage received at the D terminal at the timing of the front edge of the acquisition timing signal CLK2, or in other words, at a timing delayed compared to the FF 31. At this time, the FF 32 retains a binary signal with a logic level of 1 if the voltage value of the taken in monitor voltage is greater than or equal to a prescribed threshold and a logic level of 0 if the monitor voltage is less than the prescribed threshold, and supplies the binary signal to the inspection result register 40 as a failure determination signal f2.

The inspection result register 40 stores the failure determination signals f1 and f2 as failure inspection results for each pair of source lines among the source lines S1 to Sn of the display panel. A determination as to whether or not a failure has occurred as well as the failure state in which a distinction is made between a short-circuit failure between source lines, a disconnection failure, and a current leakage failure is represented for each corresponding pair of source lines according to the combination of logic levels indicated by the failure determination signals f1 and f2.

Below, an operation in the failure inspection mode will be explained.

In the failure inspection mode, by performing failure inspection sequentially for each pair of source lines S1 to Sn, all source lines are inspected, but here, a failure inspection operation specifically for the pair of source lines S1 and S2 will be described.

[Failure Inspection Result: No Failure]

Figure 4:
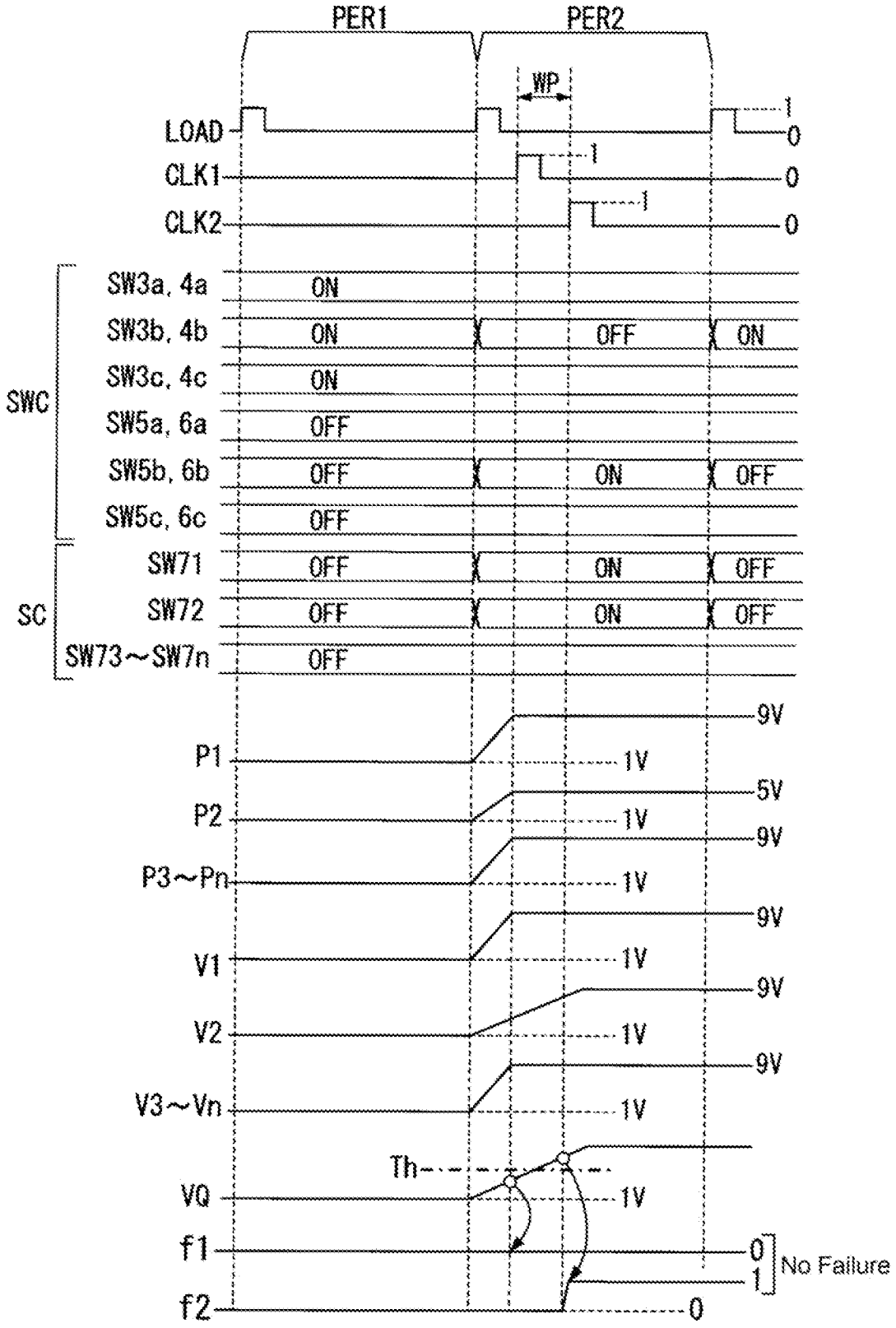
FIG. 4 is a waveform chart indicating a failure inspection control sequence and the progression of voltages of wiring lines inside the output unit 133 when no failure has occurred.

FIG. 4 is a waveform chart indicating a failure inspection control sequence for when failure inspection is performed for the source lines S1 and S2 and the progression of voltages of wiring lines inside the output unit 133 when no failure (disconnection, short-circuit, current leakage) has occurred.

In FIG. 4, the switches SW3 to SW6 of the output circuit BC1 that drives the source line S1 are represented as SW3*a* to SW6*a*, and the switches SW3 to SW6 of the output circuit BC2 that drives the source line S2 are represented as SW3*b* to SW6*b*. Also, the switches SW3 to SW6 included in other output circuits BC3 to BCn are all represented as SW3*c* to SW6*c*.

As shown in FIG. 4, the failure inspection control sequence is constituted of a reset step PER1 and an inspection step PER2 that follows.

First, during the reset step PER1, the failure inspection control unit 200 sets all of the switches SW3*a* to SW3*c* and SW4*a* to SW4*c* to be ON and all of the switches SW5*a* to SW5*c* and SW6*a* to SW6*c* to be OFF according to the failure inspection control data SWC. Also, the failure inspection control unit 200 sets all of the source line linking switches SW71 to SW7*n* to be OFF according to the linking control signal SC. As a result of the above-mentioned settings of the switches, the operational amplifier AP1 of each of the output circuits BC1 to BCn supplies a voltage generated by amplifying the voltage (P1 to Pn) received at the non-inversion input terminal thereof to the corresponding source line via the output node n1 in a manner similar to the manner of the above-mentioned operation during the normal mode.

Here, during the reset step PER1, the drive control unit 11 supplies, to the data latch unit 131, the image data signal VPD including the test data pieces representing a prescribed low voltage value such as 1V (volt) as the n test data pieces corresponding to the source lines S1 to Sn. In this case, the data latch unit 131 takes in the n test data pieces for each horizontal scanning line at the timing of an acquisition signal LOAD shown in FIG. 4, and the test data pieces are respectively supplied to the decoder unit 132 as display data J1 to Jn.

As a result, during the reset step PER1, as shown in FIG. 4, the drive voltages P1 to Pn as test voltages having a voltage value of 1V are supplied to the output circuits BC1 to BCn. As a result, the operational amplifier AP1 included in each of the output circuits BC1 to BCn supplies the 1V voltage to the corresponding external terminal (t1 to tn) via the switch SW3 and the output node n1. Thus, as shown in FIG. 4, the voltage in the external terminal (t1 to tn) corresponding to each of the output circuits BC1 to BCn, or in other words, terminal voltages V1 to Vn having a voltage value of 1V is supplied to the source lines S1 to Sn.

In other words, during the reset step PER1, the operational amplifier AP1 of each of the output circuits BC1 to BCn charges the source lines S1 to Sn at a common low voltage such as 1V, thereby resetting the source lines S1 to Sn to a uniform electric charge state.

Next, during the inspection step PER2, the failure inspection control unit 200 switches the switches SW3*b* and SW4*b* of the output circuit BC2 to OFF and switches the switches SW5*b* and SW6*b* of the output circuit BC2 to ON according to the failure inspection control data SWC. As a result, the operational amplifier AP1*b* of the output circuit BC2 functions as a comparator that outputs a current corresponding to the difference between the drive voltage P2 received by the non-inversion input terminal and the voltage received by the inversion terminal.

Also, during the inspection step PER2, the failure inspection control unit 200 sets the source line linking switches SW71 and SW72 connected to the source lines S1 and S2 subject to failure inspection to be ON according to the linking control signal SC. Additionally, the failure inspection control unit 200 supplies, to the failure determination circuit FJC, the acquisition timing signal CLK1 including a single pulse as shown in FIG. 4, and the acquisition timing signal CLK2 including a single pulse appearing at a timing delayed by a prescribed delay time WP compared to the single pulse included in the acquisition timing signal CLK1.

Also, during the inspection step PER2, the drive control unit 11 supplies, to the data latch unit 131, the image data signal VPD including the following group of test data pieces representing the test voltage to be supplied to the source lines S1 to Sn. In other words, the drive control unit 11 supplies, to the data latch unit 131, the image data signal VPD including the test data piece group representing a test voltage at a prescribed high voltage value (e.g., 9V) supplied to the respective source lines S1 and S3 to Sn, and a test data piece representing a test voltage with a voltage value corresponding to a prescribed threshold Th (e.g., 5V) of the FFs 31 and 32 supplied to the source line S2. Thus, the data latch unit 131 acquires n test data pieces for each horizontal scanning line, and supplies the test data pieces respectively to the decoder unit 132 as the display data J1 to Jn.

As a result, the voltage values of the drive voltages P1 and P3 to Pn as test voltages supplied to the output circuit BC1 and BC3 to BCn are shifted from 1V to 9V as shown in FIG. 4. Additionally, the voltage value of the drive voltage P2 as the test voltage supplied to the output circuit BC2 is shifted from 1V to the 5V corresponding to the prescribed threshold Th of the FFs 31 and 32 as shown in FIG. 4.

Figure 5:
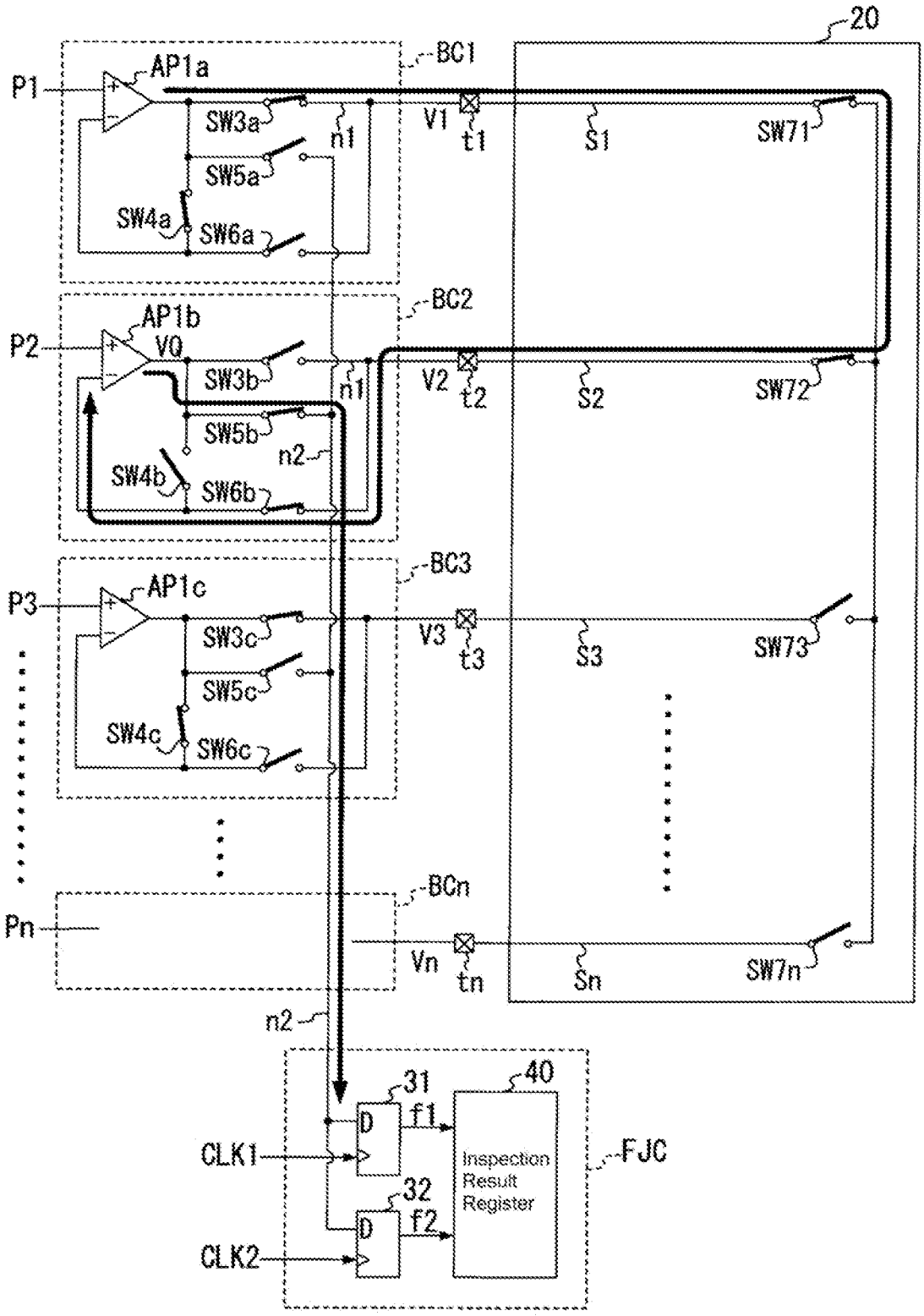
FIG. 5 is a circuit diagram showing, using bold arrows, the paths of currents flowing through the output unit 133 and the display panel 20 according to a test voltage during an inspection step PER2.

FIG. 5 is a circuit diagram showing, using bold arrows, the paths of currents flowing through the output unit 133 and the display panel 20 according to a test voltage during the inspection step PER2. In FIG. 5, the switches SW3 to SW6 of the output circuit BC1 are represented as SW3*a* to SW6*a*, the switches SW3 to SW6 of the output circuit BC2 are represented as SW3*b* to SW6*b*, and the switches SW3 to SW6 included in the output circuits BC3 to BCn are all represented as SW3*c* to SW6*c*, similarly to FIG. 4. Additionally, in FIG. 5, the operational amplifier AP1 included in the output circuit BC1 is represented as AP1*a*, the operational amplifier AP1 included in the output circuit BC2 is represented as AP1*b*, and the operational amplifiers AP1 included in the output circuits BC3 to BCn are represented as AP1*c*.

As shown with the bold arrows of FIG. 5, during the inspection step PER2, the current outputted from the operational amplifier AP1*a* of the output circuit BC1 flows into the inversion input terminal of the operational amplifier AP1*b* of the output circuit BC2 via the node n1, the source line S1, the source line linking switches SW71 and SW72, the source line S2, and the node n1 and the switch SW6*b* of the output circuit BC2.

As a result, the voltage outputted from the output circuit BC1 shifts from 1V to 9V, and a terminal voltage V1 corresponding to this voltage is applied to the first end of the source line S1.

Here, if there is no failure (disconnection, short-circuit, current leakage) in the source lines S1 and S2, then the parasitic capacitance on the source lines S1 and S2 causes the voltage value of the terminal voltage V2 of the output circuit BC2 to rise to 9V more gradually than the terminal voltage V1 as shown in FIG. 4.

The terminal voltage V2 is supplied to the inversion input terminal of the operational amplifier AP1*b* via the switch SW6*b* of the output circuit BC2. As a result, the operational amplifier AP1*b* of the output circuit BC2 outputs a current corresponding to the difference between the drive voltage P2 as the test voltage and the terminal voltage V2. As a result, the voltage VQ (hereinafter referred to as the monitor voltage) of the output terminal of the operational amplifier AP1*b* of the output circuit BC2 gradually rises from 1V as shown in FIG. 4.

In the inspection step PER2, the monitor voltage VQ outputted from the operational amplifier AP1*b* of the output circuit BC2 is supplied to the D terminals of the FFs 31 and 32 of the failure determination circuit FJC via the monitor node n2.

In this case, if there is no failure (disconnection, short-circuit, current leakage) in the source lines S1 and S2, then as shown in FIG. 4, the monitor voltage VQ is less than the prescribed threshold Th (e.g., 5 volts) at the timing of the front edge of the acquisition timing signal CLK1. Thus, the FF 31 outputs a failure determination signal f1 with a logic level of 0, and stores the failure determination signal f1 in association with the source lines S1 and S2 in the inspection result register 40. On the other hand, as shown in FIG. 4, at the timing of the front edge of the acquisition timing signal CLK2, the monitor voltage VQ is greater than or equal to the prescribed threshold Th, and thus, the FF 32 outputs a failure determination signal f2 with a logic level of 1, and stores the failure determination signal f2 in association with the source lines S1 and S2 in the inspection result register 40.

In this case, the failure determination signals f1 and f2 take on the following values:

f1=0 f2=1, and thus, a failure inspection result (f1=0, f2=1) indicating that no failure (disconnection, short-circuit, current leakage) has occurred in the source lines S1 and S2 is stored in the inspection result register 40.

[Failure Inspection Result: Short-Circuit Failure]

Next, the operation for when a short-circuit failure has occurred in the source lines S1 and S2 will be described.

Figure 6:
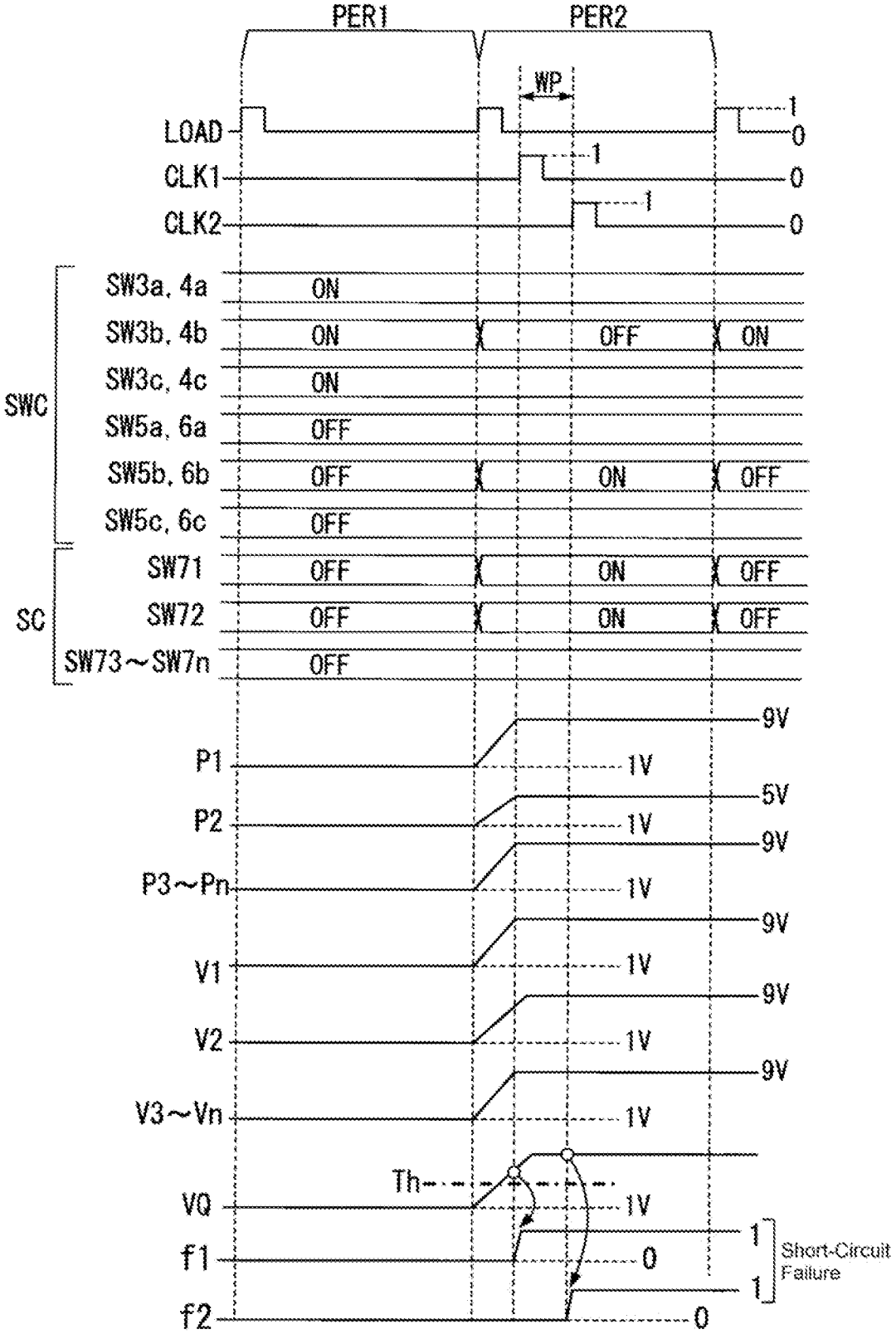
FIG. 6 is a waveform chart indicating a failure inspection control sequence and the progression of voltages of wiring lines inside the output unit 133 when a short-circuit failure has occurred.

FIG. 6 is a waveform chart indicating the progression of voltages of wiring lines inside the output unit 133 when a short-circuit failure has occurred between the source lines S1 and S2.

In FIG. 6, the operations of the failure inspection control sequence (PER', PER2) based on the acquisition signal LOAD, the acquisition timing signals CLK1 and CLK2, the failure inspection control data SWC, the linking control signals SC, and the drive voltages P1 to Pn are the same as those indicated in FIG. 4.

In other words, if there is a short-circuit between the source lines S1 and S2, such as a case in which a short-circuit has occurred between the source lines S1 and S2 in a region in the vicinity of the external terminals t1 and t2, then the current path changes and the effect of the parasitic capacitance is reduced. As a result, as shown in FIG. 6, the voltage value of the terminal voltage V2 of the output circuit BC2 rises to 9V more sharply than the terminal voltage V2 shown in FIG. 4. The terminal voltage V2 is supplied to the inversion input terminal of the operational amplifier AP1*b* via the switch SW6*b* of the output circuit BC2. As a result, the operational amplifier AP1*b* of the output circuit BC2 outputs a current corresponding to the difference between the drive voltage P2 as the test voltage and the terminal voltage V2. As a result, as shown in FIG. 6, the monitor voltage VQ outputted from the operational amplifier AP1*b* of the output circuit BC2 rises from 1V more sharply than the monitor voltage VQ shown in FIG. 4.

In the inspection step PER2, the monitor voltage VQ outputted from the operational amplifier AP1*b* of the output circuit BC2 is supplied to the D terminals of the FFs 31 and 32 of the failure determination circuit FJC via the monitor node n2. In this case, as shown in FIG. 6, the monitor voltage VQ is greater than the prescribed threshold Th at the timing of the front edge of the acquisition timing signal CLK1. Thus, the FF 31 outputs a failure determination signal f1 with a logic level of 1, and stores the failure determination signal f1 in association with the source lines S1 and S2 in the inspection result register 40. Similarly, the FF 32 also outputs a failure determination signal f2 with a logic level of 1, and stores the failure determination signal f2 in association with the source lines S1 and S2 in the inspection result register 40.

In this case, the failure determination signals f1 and f2 take on the following values:

f1=1 f2=1, and thus, a failure inspection result (f1=1, f2=1) indicating that a short-circuit failure has occurred in the source lines S1 and S2 is stored in the inspection result register 40.

[Failure Inspection Result: Current Leakage Failure, Disconnection Failure]

Next, the operation for when a current leakage failure has occurred in the source lines S1 and S2 will be described.

Figure 7:
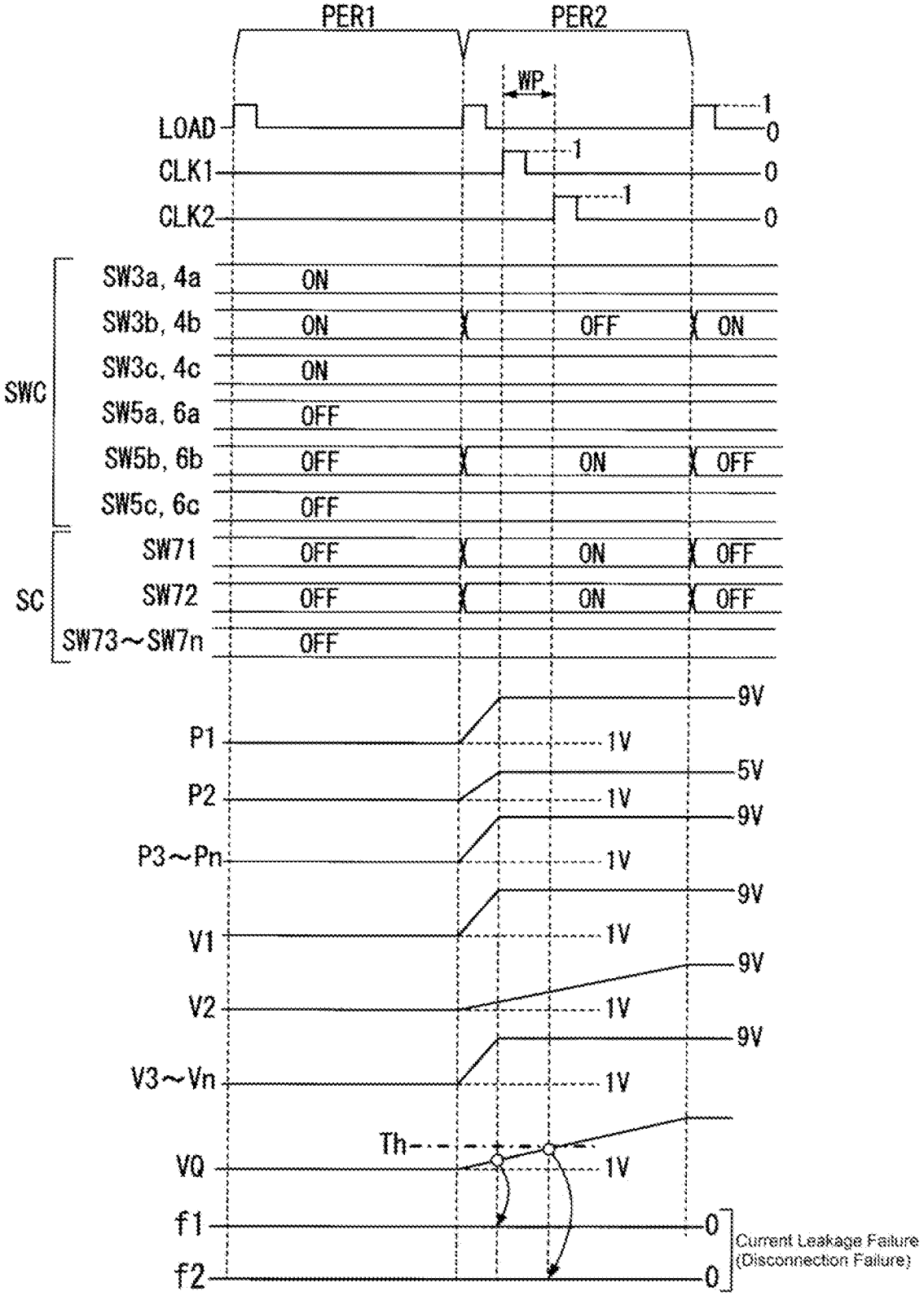
FIG. 7 is a waveform chart indicating a failure inspection control sequence and the progression of voltages of wiring lines inside the output unit 133 when a current leakage failure has occurred.

FIG. 7 is a waveform chart indicating the progression of voltages of wiring lines inside the output unit 133 when a current leakage failure has occurred in the source line S1 or S2.

In FIG. 7, the operations of the failure inspection control sequence (PER1, PER2) based on the acquisition signal LOAD, the acquisition timing signals CLK1 and CLK2, the failure inspection control data SWC, the linking control signals SC, and the drive voltages P1 to Pn are the same as those indicated in FIG. 4.

In other words, if a current leakage has occurred in the source line S1 or S2, then there is a reduction in the speed of rise of the terminal voltage V2 resulting from the current sent from the operational amplifier AP1*a* of the output circuit BC1 to the external terminal t2 of the output circuit BC2 via the source lines S1 and S2. As a result, as shown in FIG. 7, the voltage value of the terminal voltage V2 of the output circuit BC2 rises to 9V more gradually than the terminal voltage V2 shown in FIG. 4. The terminal voltage V2 is supplied to the inversion input terminal of the operational amplifier AP1*b* via the switch SW6*b* of the output circuit BC2. As a result, the operational amplifier AP1*b* of the output circuit BC2 outputs a current corresponding to the difference between the drive voltage P2 as the test voltage and the terminal voltage V2. As a result, as shown in FIG. 7, the monitor voltage VQ outputted from the operational amplifier AP1*b* of the output circuit BC2 rises from 1V more gradually than the monitor voltage VQ shown in FIG. 4.

In the inspection step PER2, the monitor voltage VQ outputted from the operational amplifier AP1*b* of the output circuit BC2 is supplied to the D terminals of the FFs 31 and 32 of the failure determination circuit FJC via the monitor node n2. In this case, as shown in FIG. 7, the monitor voltage VQ is less than the prescribed threshold Th at the timings of the front edges of both of the acquisition timing signals CLK1 and CLK2. Thus, the FF 31 outputs a failure determination signal f1 with a logic level of 0, and stores the failure determination signal f1 in association with the source lines S1 and S2 in the inspection result register 40. Similarly, the FF 32 also outputs a failure determination signal f2 with a logic level of 0, and stores the failure determination signal f2 in association with the source lines S1 and S2 in the inspection result register 40.

In this case, the failure determination signals f1 and f2 take on the following values:

f1=0 f2=0, and thus, a failure inspection result (f1=0, f2=0) indicating that a current leakage failure has occurred in the source lines S1 and S2 is stored in the inspection result register 40.

The failure inspection result (f1=0, f2=0) can also be attained when a disconnection failure has occurred between the source lines S1 and S2.

The failure inspection control unit 200 sequentially performs failure inspection not only for the source lines S1 and S2 described above, but also for other pairs of source lines. In other words, the failure inspection control unit 200 sequentially changes the combination of the output circuit (BC1 in the present embodiment) that supplies the test voltage to the source line and the output circuit (BC2 in the present embodiment) that supplies the monitor voltage VQ based on the voltage according to the source line to the failure determination circuit FJC.

As described in detail above, in the display device 100, during failure inspection mode, the decoder unit 132 supplies to the output circuits BC1 to BCn the drive voltages P1 to Pn having test voltage values for failure inspection instead of voltage values based on the image signal.

First, during the reset step PER1, the output circuits BC1 to BCn supply the output voltages GV1 to GVn having the test voltage values at a low voltage (e.g., 1 volt) to the first ends of the source lines S1 to Sn of the display panel 20. As a result, the electric charges accumulated in the source lines S1 to Sn are initialized.

Next, in during the inspection step PER2, the second ends of a pair of source lines (e.g., S1, S2) among the source lines S1 to Sn are linked via the source line linking switch SW7. Here, the decoder unit 132 supplies the first drive voltage (e.g., P1) having a high voltage (e.g., 9 volts) for the test voltage value to the first output circuit (e.g., BC1) corresponding to one (e.g., S1) of the pair of source lines. Additionally, the decoder unit 132 supplies the second drive voltage (e.g., P2) having a high voltage (e.g., 5 volts) for the test voltage value to the second output circuit (e.g., BC2) corresponding to the other (e.g., S2) of the pair of source lines. As a result, the first drive voltage is supplied to the non-inversion input terminal of the operational amplifier AP1 included in the first output circuit, and the second drive voltage is supplied to the non-inversion input terminal of the operational amplifier AP1 included in the second output circuit. During this period, in the second output circuit, the switch SW3 disconnects the connection between the output node n1 connected to the other source and the output terminal of the operational amplifier AP1, and connects the output node n1 to the inversion input terminal of the operational amplifier AP1. As a result, the test voltage supplied to the one source line (e.g., S1) is fed back to the inversion input terminal of the operational amplifier AP1 of the second output circuit via the one source line, the other source line (e.g., S2), and the output node of the second output circuit. Thus, the operational amplifier AP1 of the second output circuit outputs a voltage affected by the parasitic capacitance of the pair of source lines (e.g., S1, S2). Here, the voltage outputted from the operational amplifier AP1 of the second output circuit is designated as the monitor voltage VQ, and the failure determination circuit FJC determines the failure state (disconnection, short-circuit, current leakage, no failure) of the pair of source lines on the basis of the monitor voltage VQ.

In this manner, the display device 100 performs failure inspection using the operational amplifier AP1, which supplies the output voltage generated by amplifying the drive voltage based on the image signal to the plurality of source lines of the display panel. In other words, the test voltage for failure inspection is supplied by the operational amplifier AP1 to the source lines, and the monitor voltage VQ is acquired as test results by another operational amplifier. By acquiring the monitor voltage VQ at respectively different timings and binarizing the monitor voltage, it is possible to attain the failure determination signals (f1, f2) that enable determination of the failure state.

As a result, it is possible to perform failure inspection of the source lines of the display panel without providing an input circuit specifically for supplying a test voltage for failure inspection to the source lines, or a comparison circuit for comparing the monitor voltage that is the output result attained through the supply of the test voltage to an expected value.

Also, as described above, failure determination is performed by acquiring the monitor voltage VQ at acquisition timings (CLK1, CLK2) that are offset from each other by a prescribed delay time WP, and using signals (f1, f2) generated by binarizing the monitor voltage VQ. Here, the speed of change in the voltage value of the monitor voltage VQ attained when switching the voltage values of the test voltage (e.g., from 1 volt to 5 or 6 volts) differs depending on the current leakage amount from the source lines, for example. Thus, by setting the delay time WP to a suitable length, it is possible to accurately detect minute current leakage failures occurring in the source lines.

Therefore, according to the display device 100, it is possible to accurately detect failures occurring in the display panel while mitigating an increase in device size.

Embodiment 2

Figure 8:
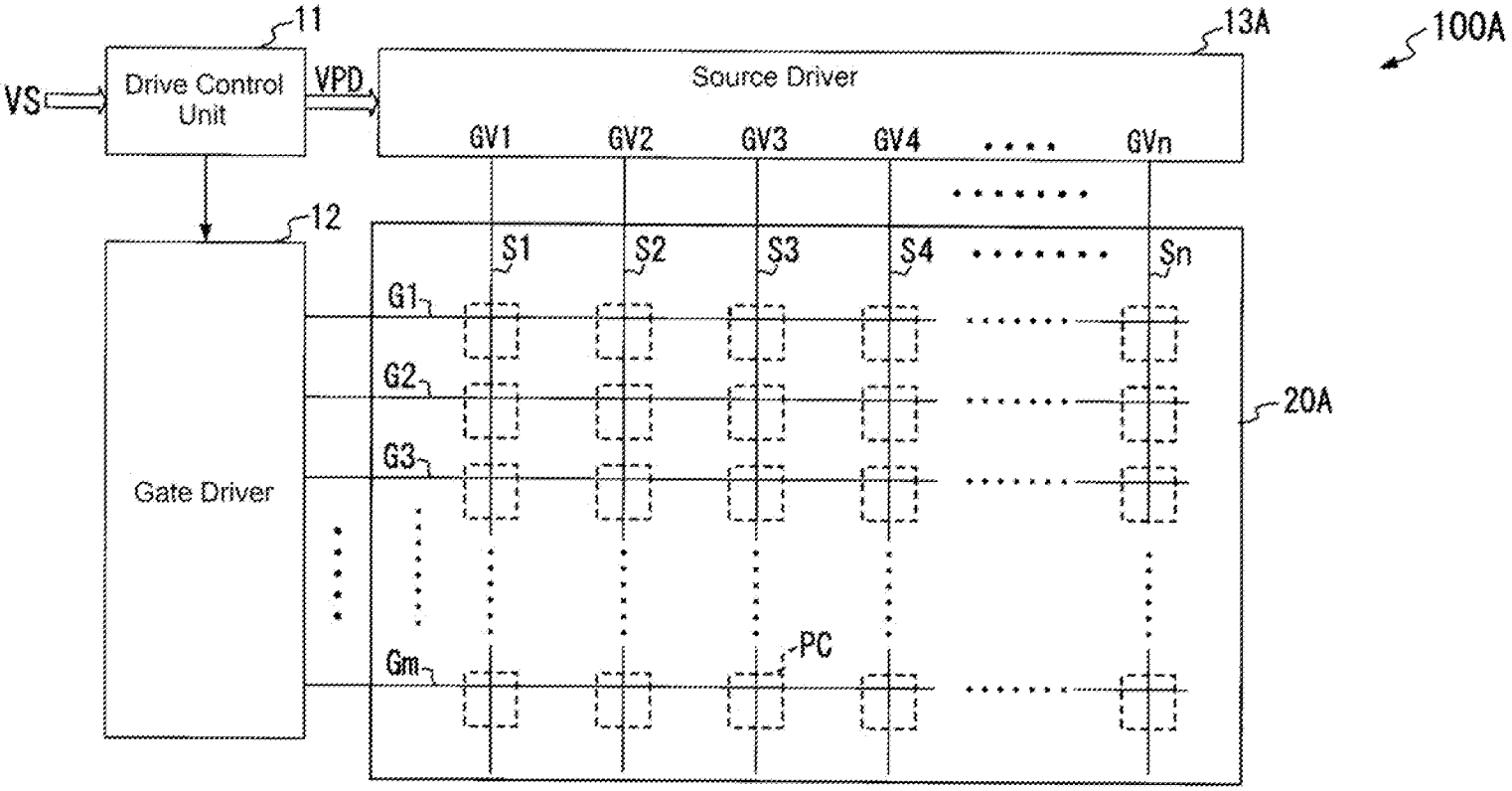
FIG. 8 is a block diagram showing a configuration of a display device 100A according to Embodiment 2.

FIG. 8 is a block diagram showing a configuration of a display device 100A according to Embodiment 2 of the present invention.

The display device 100A has a drive control unit 11, a gate driver 12, a source driver 13A, and a display panel 20A.

The drive control unit 11 and the gate driver 12 are the same as those shown in FIG. 1, and thus, explanations of operations thereof are omitted.

The display panel 20A differs from the display panel 20 shown in FIG. 1 by omitting the source line linking switches SW71 to SW7*n*, the linking line SL, and the wiring lines for the linking control signal SC, and otherwise has the same configuration as the display panel 20.

Similarly to the source driver 13 shown in FIG. 1, the source driver 13A generates n output voltages GV1 to GVn for each horizontal scanning period on the basis of the image data signal VPD supplied from the drive control unit 11, and supplies each of the output voltages GV1 to GVn to the source lines S1 to Sn of the display panel 20A.

Figure 9:
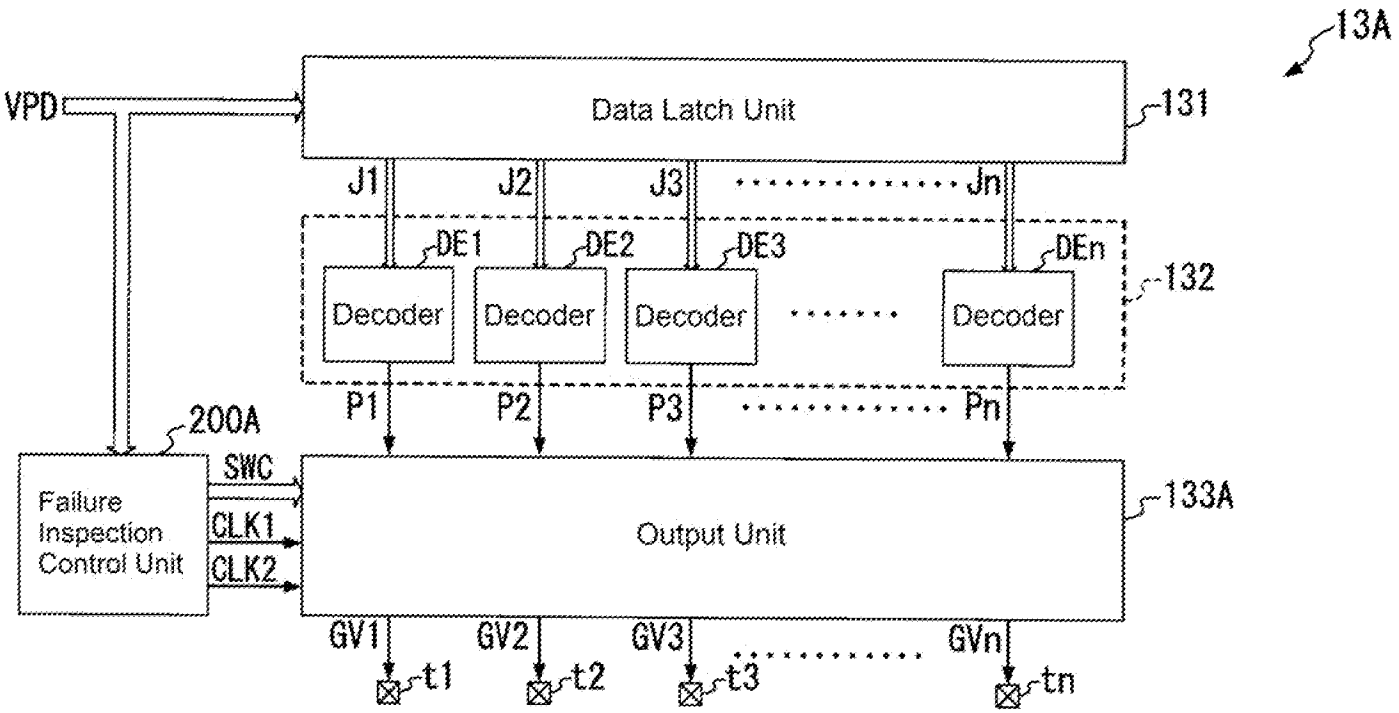
FIG. 9 is a block diagram showing an example of an internal configuration of a source driver 13A.

FIG. 9 is a block diagram showing an example of an internal configuration of the source driver 13A.

The source driver 13A includes a data latch unit 131, a decoder unit 132, an output unit 133A, and a failure inspection control unit 200A. The data latch unit 131 and the decoder unit 132 are the same as those shown in FIG. 2, and thus, explanations of operations thereof are omitted.

Similarly to the failure inspection control unit 200, the failure inspection control unit 200A generates the failure inspection control data SWC and the acquisition timing signals CLK1 and CLK2 and supplies the foregoing to the output unit 133A. However, unlike the failure inspection control unit 200, the failure inspection control unit 200A does not generate the linking control signal SC and output the same to the display panel 20A.

Similarly to the output unit 133, the output unit 133A is set to normal mode or failure inspection mode according to the failure inspection control data SWC and the acquisition timing signals CLK1 and CLK2 supplied from the failure inspection control unit 200A. During the normal mode, the output unit 133A supplies, as the output voltages GV1 to GVn, the n voltages attained by individually amplifying the drive voltages P1 to Pn supplied from the decoder unit 132, to the source lines S1 to Sn of the display panel 20A via external terminals t1 to tn. On the other hand, during the failure inspection mode, the output unit 133A performs failure inspection for detecting a failure such as a short-circuit between source lines, a disconnection or current leakage in the source lines, or the like, for the source lines S1 to Sn of the display panel 20A.

Figure 10:
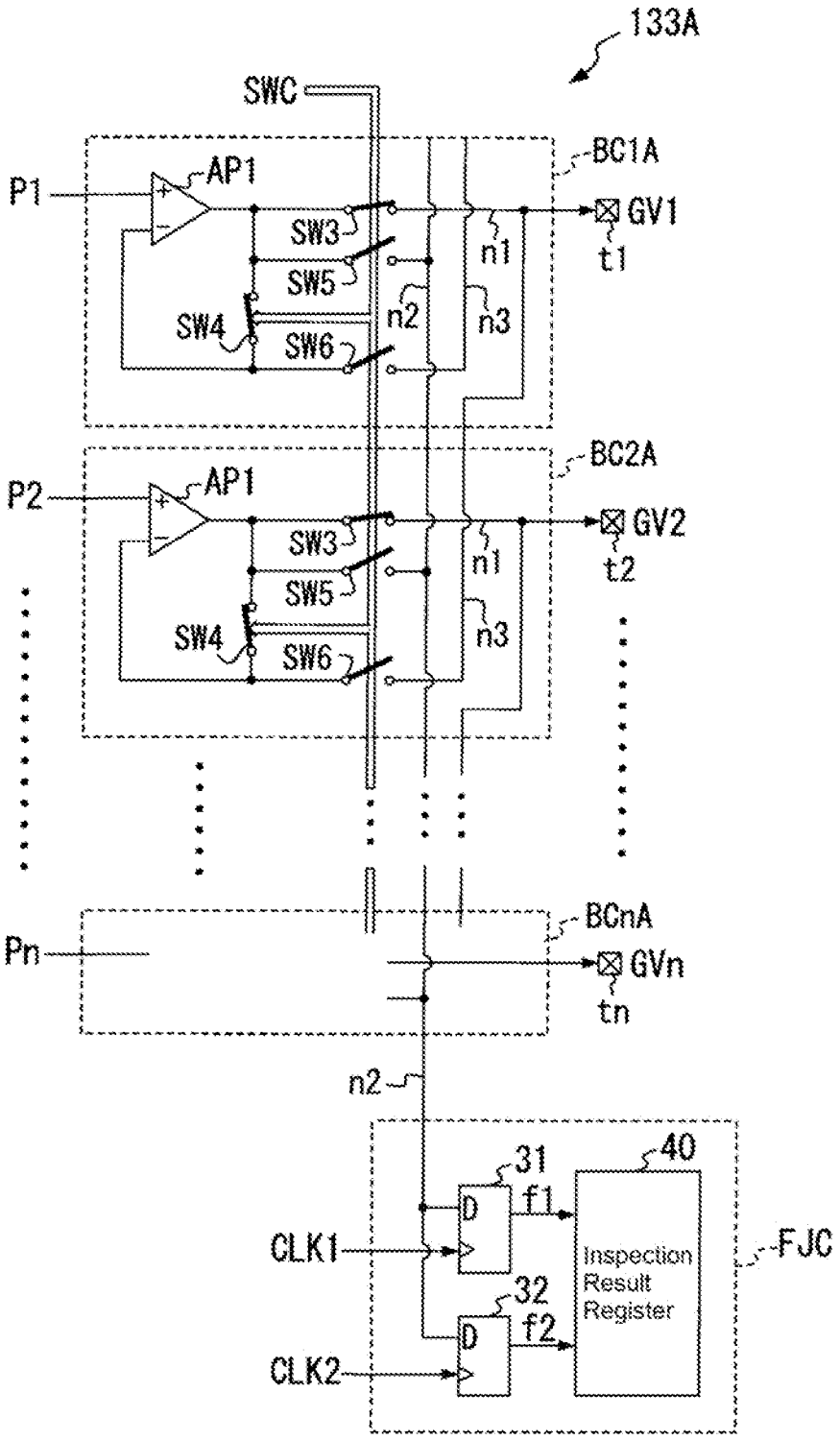
FIG. 10 is a circuit diagram showing an example of an internal configuration of an output unit 133A.

FIG. 10 is a circuit diagram showing the internal configuration of the output unit 133A.

The output unit 133A uses the output circuits BC1A to BCnA instead of the output circuits BC1 to BCn, but the failure determination circuit FJC is the same as that shown in FIG. 3.

The output circuits BC1A to BCnA have the same circuit configuration, and include the switches SW3 to SW6 and the operational amplifier AP1 as the output amplifier, which are connected in a similar manner to the manner of connection of the output circuits BC1 to BCn. However, the output circuits BC1A to BCnA each include a connection node n3 connected to the output node n1 of another output circuit. Additionally, the switch SW6 included in each of the output circuits BC1A to BCnA has the configuration, when turned ON, of connecting the connection node n3 instead of the output node n1 to the inversion input terminal of the operational amplifier AP1. In the example shown in FIG. 10, the connection node n3 of the output circuit BC2A is connected to the output node n1 of the output circuit BC1A. Thus, the switch SW6*a* of the output circuit BC2A has the configuration, when turned ON, of connecting the output node n1 of the output circuit BC1A to the inversion input terminal of the operational amplifier AP1 of the output circuit BC2A.

The switches SW3 and SW5 included in each of the output circuits BC1A to BCnA are complementarily set to the ON state and the OFF state. Thus, the switches SW3 and SW5 selectively connect the output terminal of the operational amplifier AP1 to the output node n1 or the monitor node n2 on the basis of the failure inspection control data SWC. The switches SW4 and SW6 are also complementarily set to the ON state and the OFF state. Thus, the switches SW4 and SW6 selectively connect the inversion input terminal of the operational amplifier AP1 to the output terminal thereof or the connection node n3.

Thus, the switches SW3 to SW6 function as connection switching units that selectively connect the output terminal of the operational amplifier AP1 to the output node n1 or the monitor node n2 and selectively connect the inversion input terminal of the operational amplifier AP1 to the output terminal thereof or the connection node n3.

Thus, in the display device 10A shown in FIGS. 8 to 10, the source line linking switches SW71 to 7*n* included in the display panel 20 are eliminated, and within each of the output circuits BC1A to BCnA, the output nodes n1 of adjacent output circuits BC are connected to the inversion input terminals of the operational amplifiers AP1 via the connection nodes n3 and the switches SW6.

Similarly to the output unit 133, in the output unit 133A as well, control is performed according to the failure inspection control sequence (PER1, PER2) shown in FIG. 4 on the basis of the acquisition signal LOAD, the acquisition timing signals CLK1 and CLK2, the failure inspection control data SWC, and the drive voltages P1 to Pn.

Figure 11:
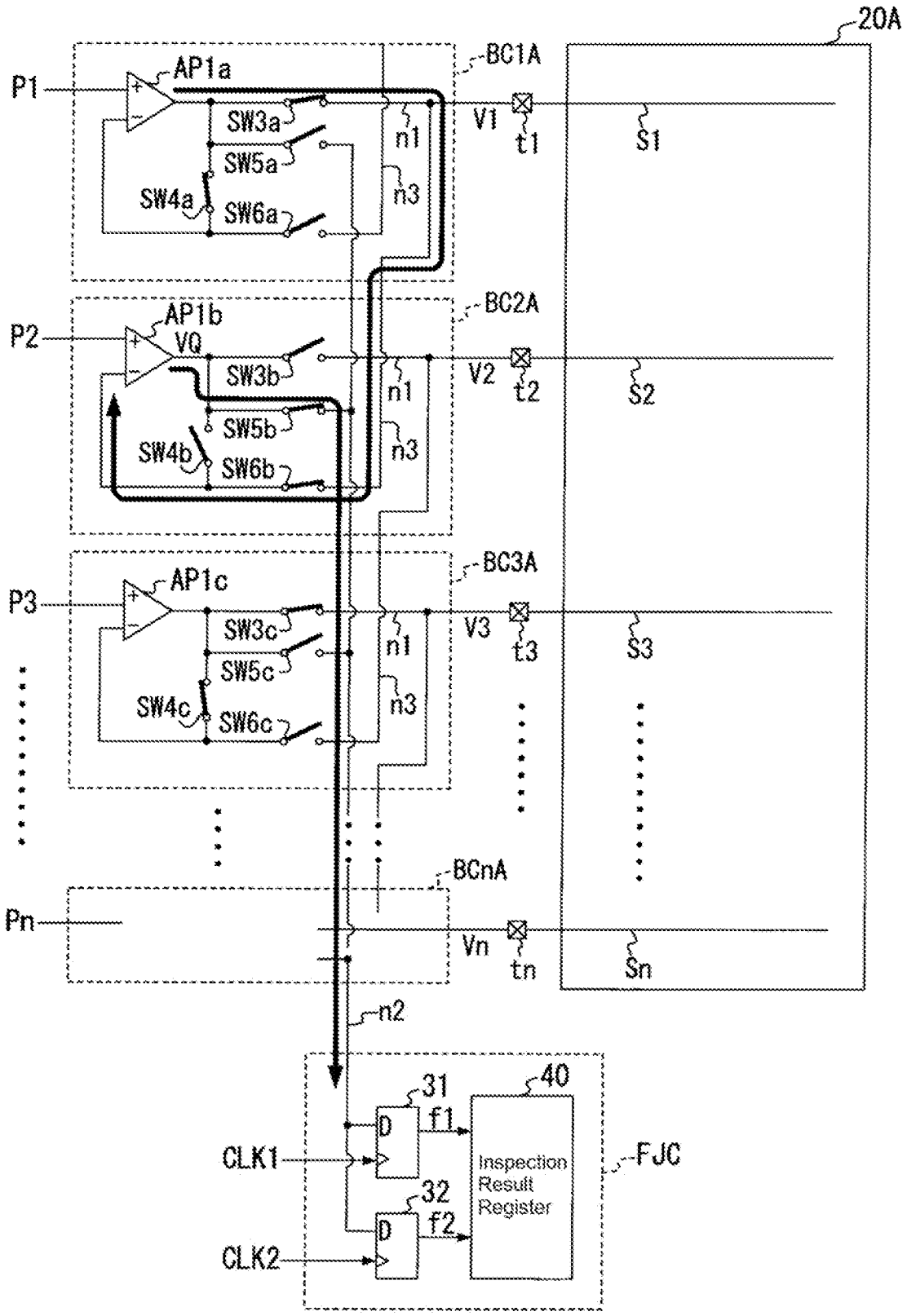
FIG. 11 is a circuit diagram showing, using bold arrows, the paths of currents flowing through the output unit 133A according to a test voltage during an inspection step PER2.

FIG. 11 is a circuit diagram showing, using bold arrows, the paths of currents flowing through the output unit 133A according to a test voltage during an inspection step PER2 of the failure inspection control sequence. In FIG. 11, the switches SW3 to SW6 of the output circuit BC1A are represented as SW3*a* to SW6*a*, and the switches SW3 to SW6 of the output circuit BC2A are represented as SW3*b* to SW6*b*. Also, the switches SW3 to SW6 included in other output circuits BC3A to BCnA are all represented as SW3*c* to SW6*c*. Additionally, in FIG. 11, the operational amplifier AP1 included in the output circuit BC1A is represented as AP1*a*, the operational amplifier AP1 included in the output circuit BC2A is represented as AP1*b*, and the operational amplifiers AP1 included in the output circuits BC3A to BCAn are represented as AP1*c*.

As shown with the bold arrows of FIG. 11, during the inspection step PER2, the current outputted from the operational amplifier AP1*a* of the output circuit BC1A flows into the inversion input terminal of the operational amplifier AP1*b* of the output circuit BC2A via the node n1, and the connection node n3 and the switch SW6*b* of the output circuit BC2A.

As a result, the voltage outputted from the output circuit BC1A shifts from 1V to 9V, and a terminal voltage V1 corresponding to this voltage is applied to the first end of the source line S1.

Here, if there is no failure (disconnection, short-circuit, current leakage) in the source line S1, then the parasitic capacitance on the source line S1 causes the voltage value of the terminal voltage V1 to rise gradually to 9V.

The terminal voltage V1 is supplied to the inversion input terminal of the operational amplifier AP1*b* via the connection node n3 and the switch SW6*b* of the output circuit BC2A. As a result, the operational amplifier AP1*b* of the output circuit BC2A outputs a current corresponding to the difference between the drive voltage P2 as the test voltage and the terminal voltage V1. Thus, the monitor voltage VQ that is the voltage of the output terminal of the operational amplifier AP1*b* of the output circuit BC2A gradually rises from 1V.

In the inspection step PER2, the monitor voltage VQ outputted from the operational amplifier AP1*b* of the output circuit BC2A is supplied to the D terminals of the FFs 31 and 32 of the failure determination circuit FJC via the monitor node n2.

In this case, if there is no failure (disconnection, short-circuit, current leakage) in the source line S1, then as shown in FIG. 4, the monitor voltage VQ is less than the prescribed threshold Th at the timing of the front edge of the acquisition timing signal CLK1. Thus, the FF 31 outputs a failure determination signal f1 with a logic level of 0, and stores the failure determination signal f1 in association with the source line S1 in the inspection result register 40. On the other hand, as shown in FIG. 4, at the timing of the front edge of the acquisition timing signal CLK2, the monitor voltage VQ is greater than or equal to the prescribed threshold Th, and thus, the FF 32 outputs a failure determination signal f1 with a logic level of 1, and stores the failure determination signal f1 in association with the source line S1 in the inspection result register 40.

In this case, the failure determination signals f1 and f2 take on the following values:

f1=0 f2=1, and thus, a failure inspection result (f1=0, f2=1) indicating that no failure (disconnection, short-circuit, current leakage) has occurred in the source line S1 is stored in the inspection result register 40.

On the other hand, if there is a disconnection in the source line S1, then the parasitic capacitance on the source line S1 is reduced, causing the voltage value of the terminal voltage V1 of the output circuit BC1A to rise sharply to 9V in a manner similar to the manner shown in FIG. 6. The terminal voltage V1 is supplied to the inversion input terminal of the operational amplifier AP1*b* via the switch SW6*b* of the output circuit BC2A. Thus, the monitor voltage VQ outputted from the operational amplifier AP1*b* of the output circuit BC2A rises sharply so as to follow the rise in voltage value of the terminal voltage V1, and therefore, the monitor voltage VQ increases to greater than the prescribed threshold Th at the timings of the front edges of both of the acquisition timing signals CLK1 and CLK2. Thus, the FF 31 outputs a failure determination signal f1 with a logic level of 1, and stores the failure determination signal f1 in association with the source line S1 in the inspection result register 40. Similarly, the FF 32 also outputs a failure determination signal f2 with a logic level of 1, and stores the failure determination signal f2 in association with the source line S1 in the inspection result register 40.

In this case, the failure determination signals f1 and f2 take on the following values:

f1=1 f2=1, and thus, a failure inspection result (f1=1, f2=1) indicating that a disconnection failure has occurred in the source line S1 is stored in the inspection result register 40.

Also, if there is a short-circuit between the source line S1 and another source line, or if a current leak has occurred in the source line S1, then the speed of rise in the terminal voltage V1 according to the current sent from the operational amplifier AP1*a* of the output circuit BC1A decreases. In other words, the voltage value of the terminal voltage V1 of the output circuit BC1A rises to 9V at a similarly gradual rate to the terminal voltage V2 shown in FIG. 7. The terminal voltage V1 is supplied to the inversion input terminal of the operational amplifier AP1*b* via the switch SW6*b* of the output circuit BC2A. Thus, the monitor voltage VQ outputted from the operational amplifier AP1*b* of the output circuit BC2A rises gradually so as to follow the gradual rise in voltage value of the terminal voltage V1. As a result, the monitor voltage VQ is less than the prescribed threshold Th at the timings of the front edges of both of the acquisition timing signals CLK1 and CLK2. Thus, the FF 31 outputs a failure determination signal f1 with a logic level of 0, and stores the failure determination signal f1 in association with the source line S1 in the inspection result register 40. Similarly, the FF 32 also outputs a failure determination signal f2 with a logic level of 0, and stores the failure determination signal f2 in association with the source line S1 in the inspection result register 40.

In this case, the failure determination signals f1 and f2 take on the following values:

f1=0 f2=0, and thus, a failure inspection result (f1=0, f2=0) indicating that a short-circuit failure or a current leakage failure has occurred in the source line S1 is stored in the inspection result register 40.

As described in detail above, in the display device 100A, during failure inspection mode, the decoder unit 132 supplies to the output circuits BC1A to BCnA the drive voltages P1 to Pn having test voltage values for failure inspection instead of voltage values based on the image signal.

First, during the reset step PER1, the output circuits BC1A to BCnA supply the output voltages GV1 to GVn having the test voltage values at a low voltage (e.g., 1 volt) to the first ends of the source lines S1 to Sn of the display panel 20A. As a result, the electric charges accumulated in the source lines S1 to Sn are initialized.

Next, in the inspection step PER2, the decoder unit 132 supplies the first drive voltage (e.g., P1) having a high voltage (e.g., 9 volts) for the test voltage value to the first output circuit (e.g., BC1A) corresponding to one (e.g., S1) of the pair of source lines (e.g., S1, S2). Additionally, the decoder unit 132 supplies the second drive voltage (e.g., P2) having a high voltage (e.g., 5 volts) for the test voltage value to the second output circuit (e.g., BC2A) corresponding to the other (e.g., S2) of the pair of source lines. As a result, the first drive voltage is supplied to the non-inversion input terminal of the operational amplifier AP1 included in the first output circuit, and the second drive voltage is supplied to the non-inversion input terminal of the operational amplifier AP1 included in the second output circuit. During this period, in the second output circuit, the switch SW3 disconnects the connection between the output node n1 connected to the other source and the output terminal of the operational amplifier AP1, and connects the output node n1 of the first output circuit to the inversion input terminal of the operational amplifier AP1. As a result, the operational amplifier AP1 of the second output circuit outputs a voltage affected by the parasitic capacitance of the one source line. Here, the voltage outputted from the operational amplifier AP1 of the second output circuit is designated as the monitor voltage VQ, and the failure determination circuit FJC determines the failure state (disconnection, short-circuit, current leakage, no failure) of the pair of source lines on the basis of the monitor voltage VQ.

In this manner, similarly to the display device 100, the display device 100A performs failure inspection using the operational amplifier AP1, which supplies the output voltage generated by amplifying the drive voltage based on the image signal to the plurality of source lines of the display panel. In other words, the test voltage for failure inspection is supplied by one operational amplifier AP1 to the source lines, and the monitor voltage VQ is acquired as test results by another operational amplifier. By acquiring the monitor voltage VQ at respectively different timings and binarizing the monitor voltage, it is possible to attain the failure determination signals (f1, f2) that enable determination of the failure state.

As a result, it is possible to perform failure inspection of the source lines of the display panel without providing an input circuit specifically for supplying a test voltage for failure inspection to the source lines, or a comparison circuit for comparing the monitor voltage that is the output result attained through the supply of the test voltage to an expected value.

Also, as described above, failure determination is performed by acquiring the monitor voltage VQ at acquisition timings (CLK1, CLK2) that are offset from each other by a prescribed delay time WP, and using signals (f1, f2) generated by binarizing the monitor voltage VQ. Here, the speed of change in the voltage value of the monitor voltage VQ attained when switching the voltage values of the test voltage (e.g., from 1 volt to 5 or 6 volts) differs depending on the current leakage amount from the source lines, for example. Thus, by setting the delay time WP to a suitable length, it is possible to accurately detect minute current leakage failures occurring in the source lines.

Additionally, according to the display device 100A, it is possible to inspect the failure state (disconnection, short-circuit, current leakage) of each source line in a manner similar to the manner of the display device 100 without providing the source line linking switches SW71 to SW7*n* shown in FIG. 1.

Embodiment 3

Figure 12:
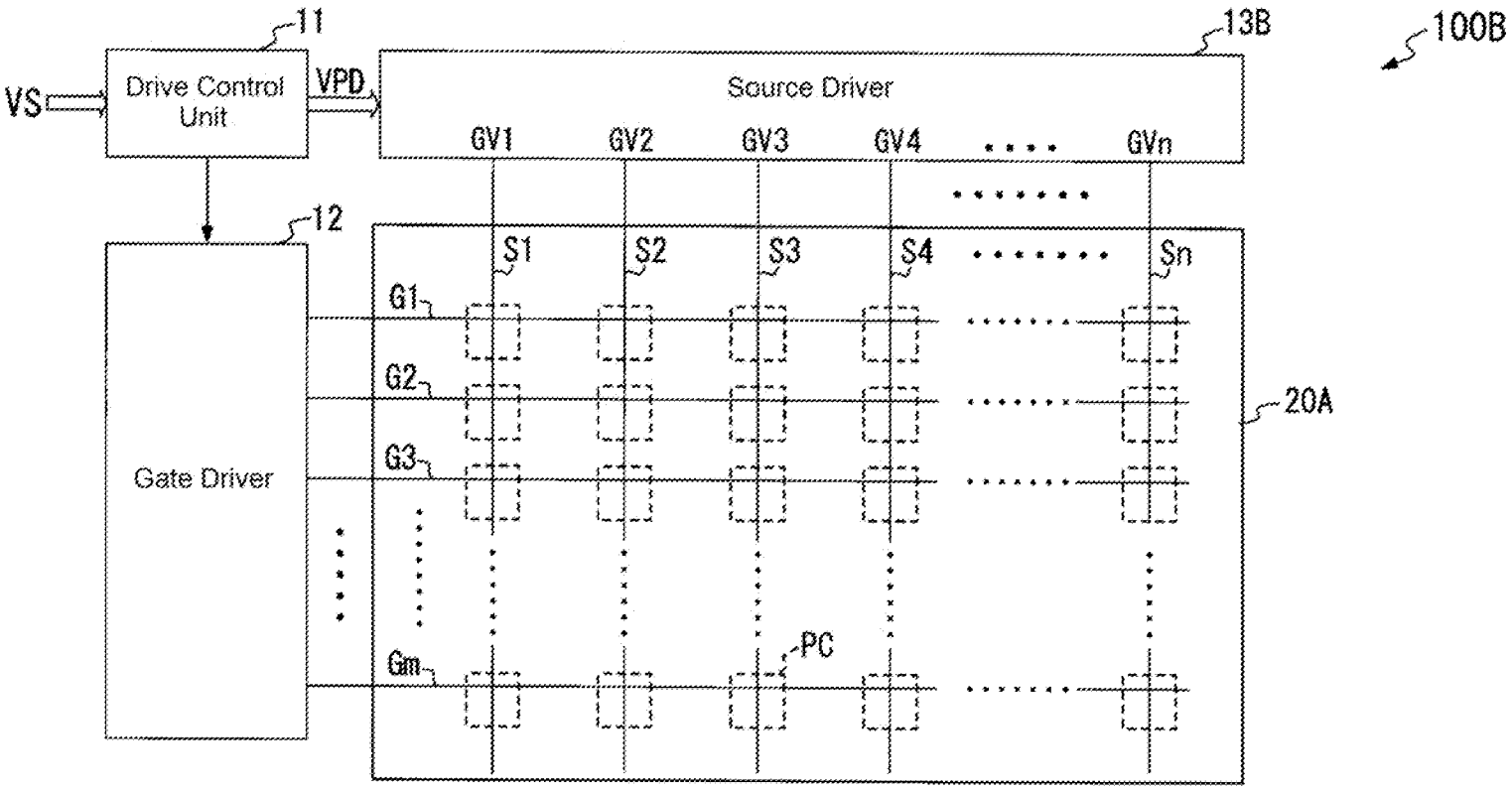
FIG. 12 is a block diagram showing a configuration of a display device 100B according to Embodiment 3.

FIG. 12 is a block diagram showing a configuration of a display device 100B according to Embodiment 3 of the present invention.

The display device 100B has a drive control unit 11, a gate driver 12, a source driver 13B, and a display panel 20A.

The drive control unit 11, the gate driver 12, and the display panel 20A are the same as those shown in FIG. 8, and thus, explanations thereof are omitted.

Similarly to the source driver 13A shown in FIG. 8, the source driver 13B generates n output voltages GV1 to GVn for each horizontal scanning period on the basis of the image data signal VPD supplied from the drive control unit 11, and supplies each of the output voltages GV1 to GVn to the source lines S1 to Sn of the display panel 20A.

Figure 13:
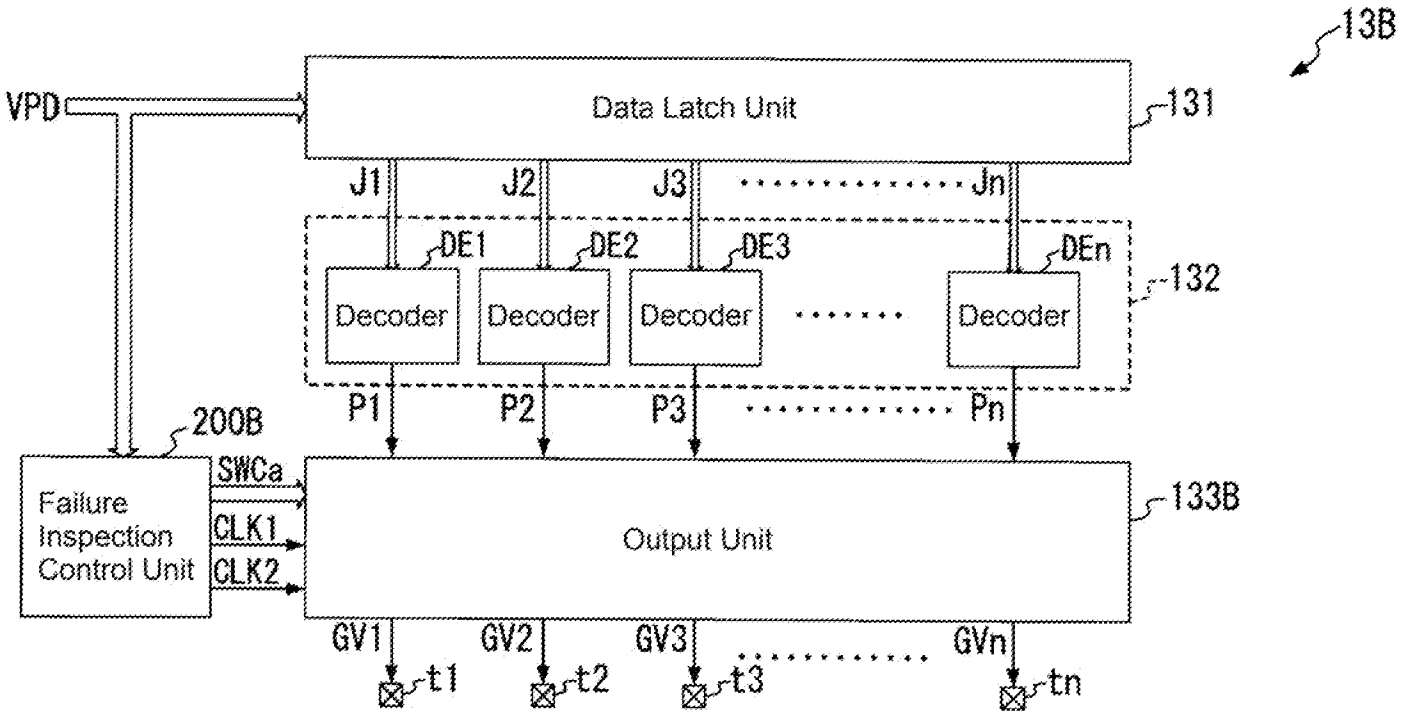
FIG. 13 is a block diagram showing an example of an internal configuration of a source driver 13B.

FIG. 13 is a block diagram showing an example of an internal configuration of the source driver 13B.

The source driver 13B includes a data latch unit 131, a decoder unit 132, an output unit 133B, and a failure inspection control unit 200B. The data latch unit 131 and the decoder unit 132 are the same as those shown in FIG. 9, and thus, explanations of operations thereof are omitted.

Similarly to the failure inspection control unit 200A, the failure inspection control unit 200B generates the acquisition timing signals CLK1 and CLK2 and supplies the foregoing to the output unit 133A. The failure inspection control unit 200B supplies the failure inspection control data SWCa instead of the failure inspection control data SWC to the output unit 133A.

Similarly to the output unit 133A, the output unit 133B is set to normal mode or failure inspection mode according to the failure inspection control data SWCa and the acquisition timing signals CLK1 and CLK2 supplied from the failure inspection control unit 200B. During the normal mode, the output unit 133B supplies, as the output voltages GV1 to GVn, the n voltages attained by individually amplifying the drive voltages P1 to Pn supplied from the decoder unit 132, to the source lines S1 to Sn of the display panel 20A via external terminals t1 to tn. On the other hand, during the failure inspection mode, the output unit 133B performs failure inspection for detecting a failure such as a short-circuit between source lines, a disconnection or current leakage in the source lines, or the like, for the source lines S1 to Sn of the display panel 20A.

Figure 14:
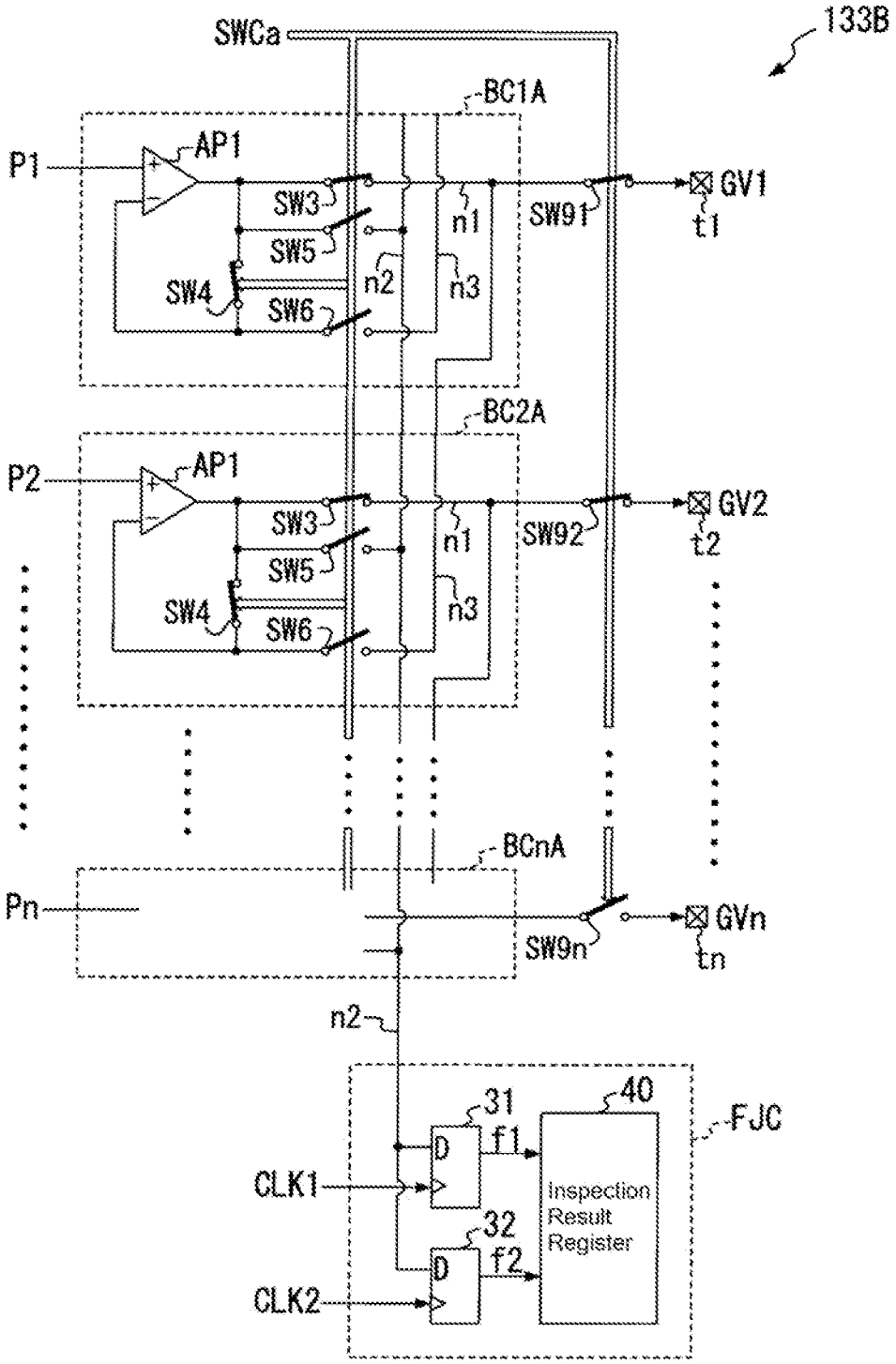
FIG. 14 is a circuit diagram showing an example of an internal configuration of an output unit 133B.

FIG. 14 is a circuit diagram showing the internal configuration of the output unit 133B.

As shown in FIG. 14, the output unit 133B includes the output circuits BC1A to BCnA, the failure determination circuit FJC, and the output switches SW91 to SW9*n*. In the output unit 133B, output switches SW91 to SW9*n* are provided between the output nodes n1 of the respective output circuits BC1A to BCnA and corresponding external terminals (t1 to tn), and the output circuits BC1A to BCnA and the failure determination circuit FJC are the same as those shown in FIG. 10.

Figure 15:
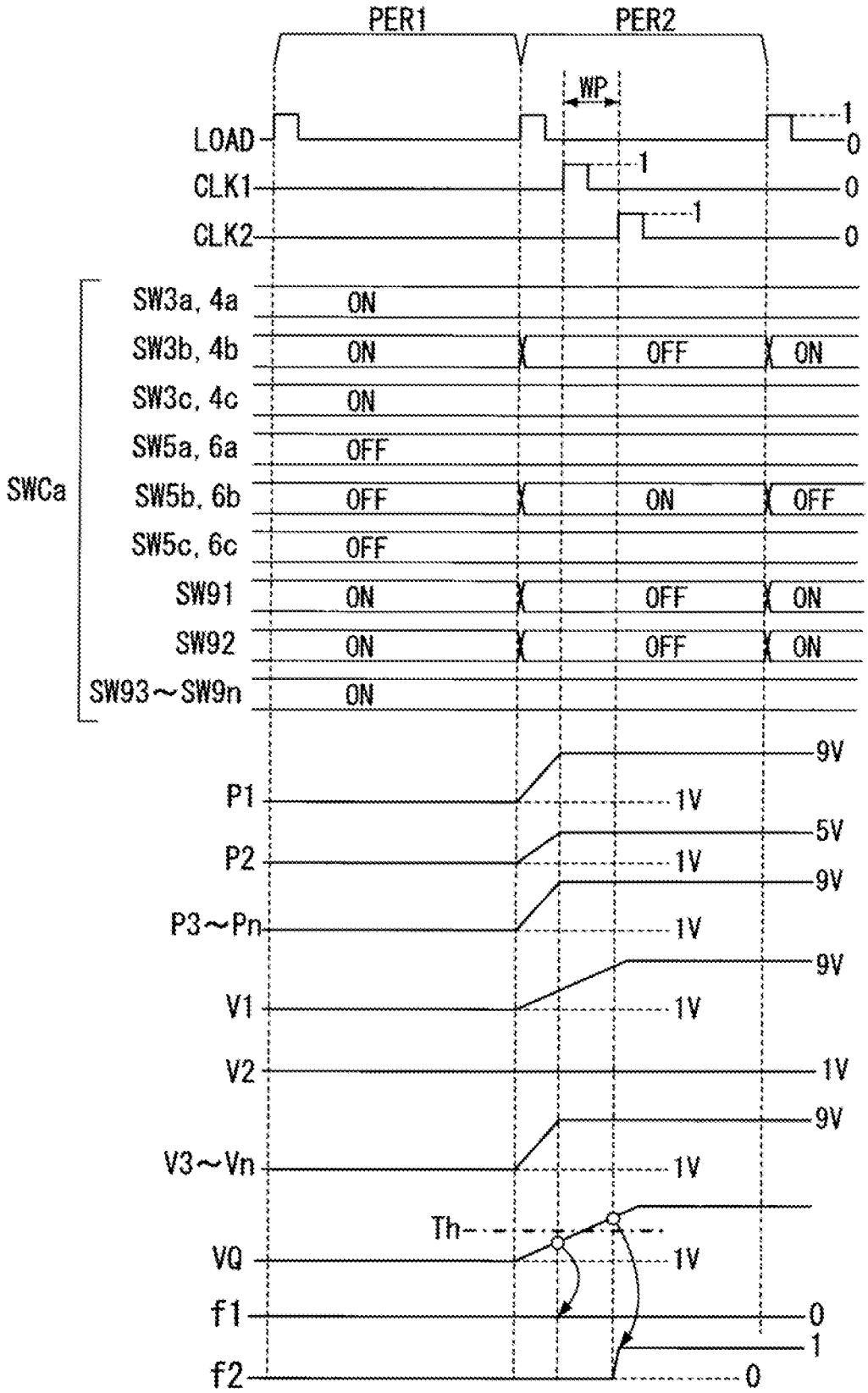
FIG. 15 is a waveform chart indicating a failure inspection control sequence and the progression of voltages of wiring lines inside the output unit 133B when no failure has occurred.

FIG. 15 is a waveform chart indicating a failure inspection control sequence for when failure inspection is performed for the source lines S1 and S2 and the progression of voltages of wiring lines inside the output unit 133B when no failure (disconnection, short-circuit, current leakage) has occurred.

In FIG. 15, the switches SW3 to SW6 of the output circuit BC1A are represented as SW3*a* to SW6*a*, and the switches SW3 to SW6 of the output circuit BC2A are represented as SW3*b* to SW6*b*. Also, the switches SW3 to SW6 included in other output circuits BC3A to BCnA are all represented as SW3*c* to SW6*c*.

As shown in FIG. 15, the switch groups (SW3*a* to SW6*a*, SW3*b* to SW6*b*, SW3*c* to SW6*c*) of the output circuits BC1A to BCnA are controlled to be ON or OFF in a manner similar to the manner of the failure inspection control sequence (PER1, PER2) shown in FIG. 4 according to the failure inspection control data SWCa.

Also, the output switches SW91 to SW9*n* are all set to be ON in the reset step PER1 as shown in FIG. 15 according to the failure inspection control data SWCa. During the inspection step PER2, only the output switch SW91 of the output circuit BC1A that drives the source line S1 under inspection and the output switch SW92 of the output circuit BC2A that drives the source line S2 are switched to be OFF according to the failure inspection control data SWCa.

Additionally, similarly to the output unit 133A, in the output unit 133B as well, control is performed according to the failure inspection control sequence (PER1, PER2) shown in FIG. 4 on the basis of the acquisition signal LOAD, the acquisition timing signals CLK1 and CLK2, the failure inspection control data SWCa, and the drive voltages P1 to Pn.

Figure 16:
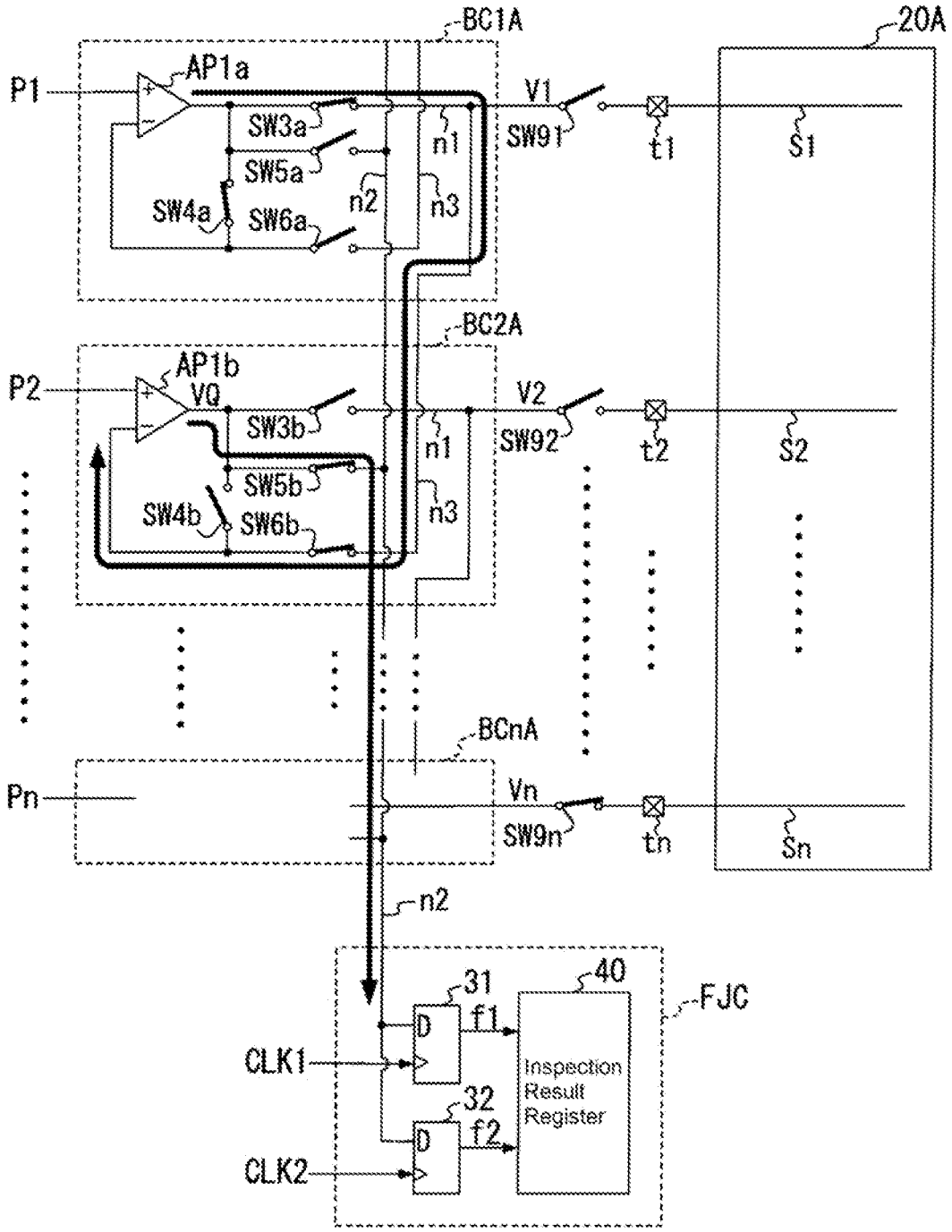
FIG. 16 is a circuit diagram showing, using bold arrows, the paths of currents flowing through the output unit 133B according to a test voltage during an inspection step PER2.

FIG. 16 is a circuit diagram showing, using bold arrows, the paths of currents flowing through the output unit 133B according to a test voltage during an inspection step PER2 of the failure inspection control sequence. In FIG. 16, the switches SW3 to SW6 of the output circuit BC1A are represented as SW3*a* to SW6*a*, and the switches SW3 to SW6 of the output circuit BC2A are represented as SW3*b* to SW6*b*. Additionally, in FIG. 16, the operational amplifier AP1 included in the output circuit BC1A is represented as AP1*a* and the operational amplifier AP1 included in the output circuit BC2A is represented as AP1*b*.

As shown with the bold arrows of FIG. 16, during the inspection step PER2, the current outputted from the operational amplifier AP1*a* of the output circuit BC1A flows into the inversion input terminal of the operational amplifier AP1*b* of the output circuit BC2A via the node n1, and the connection node n3 and the switch SW6*b* of the output circuit BC2A.

As a result, the voltage outputted from the output circuit BC1A shifts from 1V to 9V, and a terminal voltage V1 corresponding to this voltage is supplied to the inversion input terminal of the operational amplifier AP1*b* of the output circuit BC2A. During this period, the output switch SW91 is turned OFF, and thus, the voltage of the inversion input terminal of the operational amplifier AP1*b* of the output circuit BC2A rises to 9V so as to follow the terminal voltage V1 without being affected by the parasitic capacitance on the source line S1. As a result, if no failure occurs in the output circuits BC1A and BC2A, the operational amplifier AP1*b* of the output circuit BC2A outputs a current corresponding to the difference between the drive voltage P2 as the test voltage and the terminal voltage V1, and the monitor voltage VQ accordingly rises as shown in FIG. 15.

In the inspection step PER2, the monitor voltage VQ outputted from the operational amplifier AP1*b* of the output circuit BC2 is supplied to the D terminals of the FFs 31 and 32 of the failure determination circuit FJC via the monitor node n2.

In the failure determination circuit FJC included in the output unit 133B, if the failure inspection performed according to the failure inspection sequence shown in FIG. 15 yields the result that the failure determination signals f1 and f2 stored in the inspection result register 40 do not take on the following values:

f1=0 f2=1, then it is determined that a failure has occurred.

In the display device 100B shown in FIG. 12, by performing the failure inspection according to the failure inspection sequence shown in FIG. 15 and keeping all output switches SW91 to SW9*n* ON, the failure inspection (FIG. 4) by the display device 100A shown in FIG. 8 is performed.

In this case, if a result that a failure has occurred is attained through both the failure inspection according to the failure inspection sequence shown in FIG. 15 and the failure inspection (FIG. 4) performed by the display device 100A shown in FIG. 8, it is determined that the failure has occurred in the source driver 13B and not the display panel 20A.

Thus, the output unit 133B is provided with the output switches SW91 to 9*n* that can disconnect the connection between the source lines of the display panel 20A. As a result, it is possible to perform failure inspection in a state where the source driver 13B is connected to the display panel 20A and to perform failure inspection in a state where the source driver 13B and the display panel 20A are disconnected from each other, and thus, it is possible to determine whether the failure has occurred in the display panel 20A or in the source driver 13B.

Embodiment 4

Figure 17:
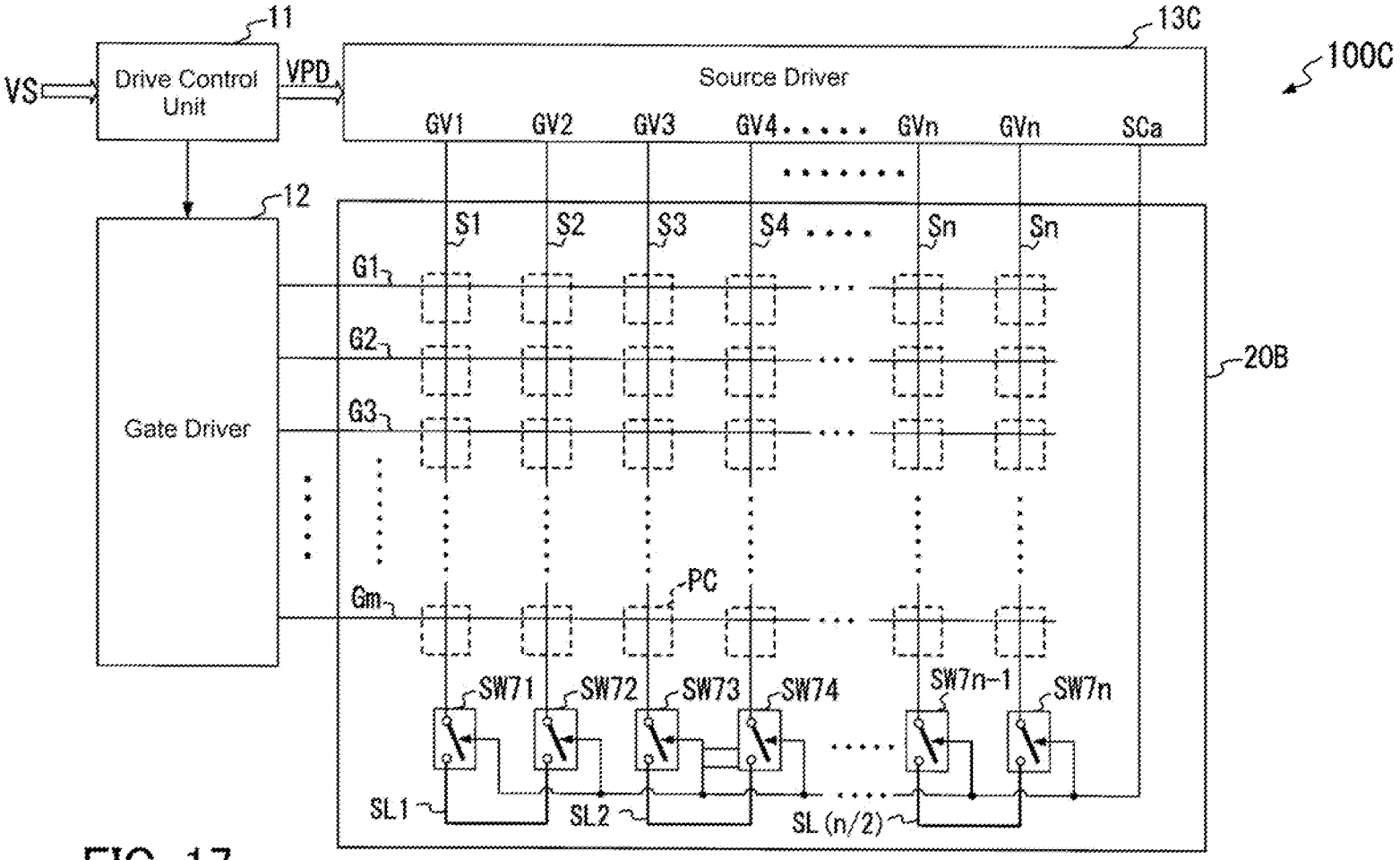
FIG. 17 is a block diagram showing a configuration of a display device 100C according to Embodiment 4.

FIG. 17 is a block diagram showing a configuration of a display device 100C according to Embodiment 4 of the present invention.

The display device 100C has a drive control unit 11, a gate driver 12, a source driver 13C, and a display panel 20B.

The drive control unit 11 and the gate driver 12 are the same as those shown in FIG. 1, and thus, explanations of operations thereof are omitted.

Similarly to the display panel 20 shown in FIG. 1, the display panel 20B is provided with the source lines S1 to Sn, the gate lines G1 to Gn, and the source line linking switches SW71 to 7*n*. However, the source line linking switches SW71 to SW7*n* provided in the display panel 20B are controlled together to all be ON or OFF according to a single linking control signal SCa.

Also, as shown in FIG. 17, the first end of each of the source line linking switches SW71 to SW7*n* is connected individually to the first end of each of the source lines S1 to Sn. Also, for each pair of switches constituted of a combination of an odd-numbered source line linking switch SW7(2*k*−1) (k being an integer of 1 or greater) among the source line linking switches SW71 to SW7*n* and an even-numbered source line linking switch SW7(2*k*) adjacent thereto, the second ends of the pair of switches are connected by a linking line SL1 to SL(n/2).

Similarly to the source driver 13 shown in FIG. 1, the source driver 13C generates n output voltages GV1 to GVn for each horizontal scanning period on the basis of the image data signal VPD supplied from the drive control unit 11, and supplies each of the output voltages GV1 to GVn to the source lines S1 to Sn of the display panel 20.

Figure 18:
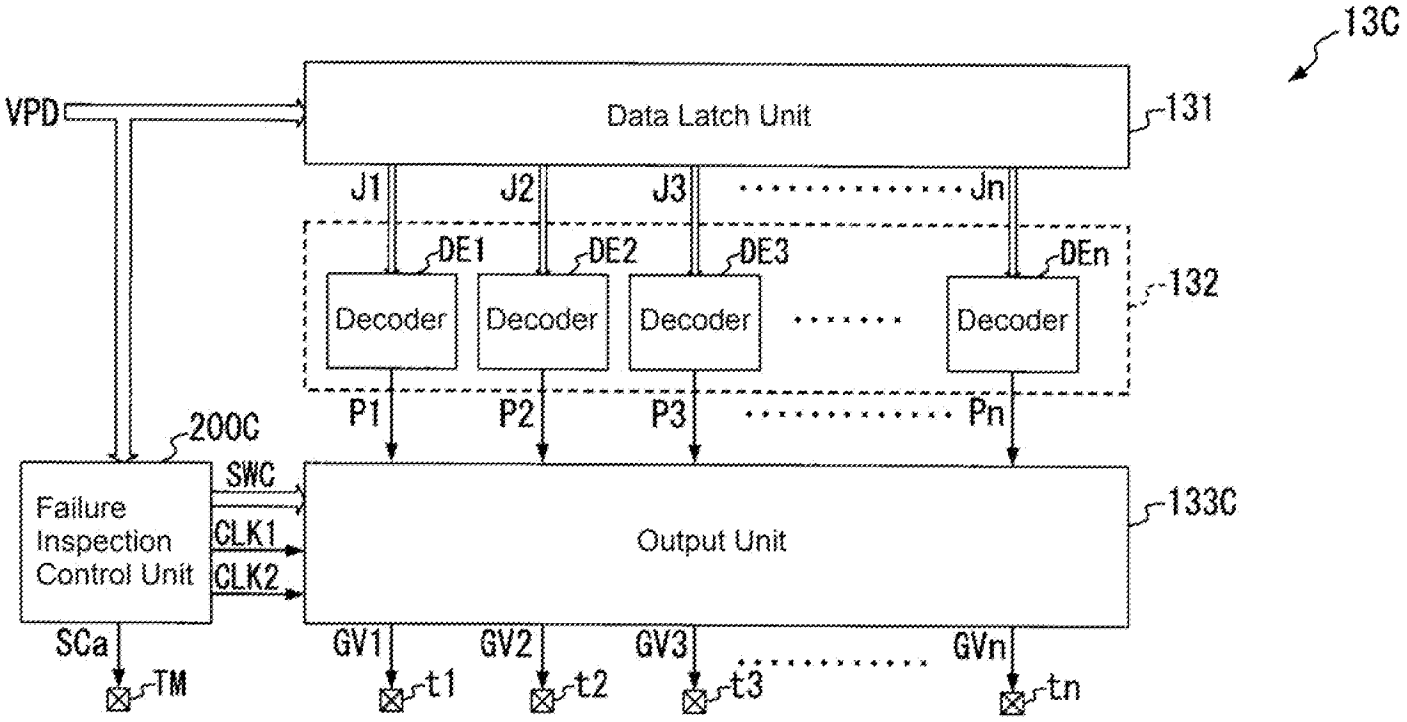
FIG. 18 is a block diagram showing an example of an internal configuration of a source driver 13C.

FIG. 18 is a block diagram showing an example of an internal configuration of the source driver 13C.

The source driver 13C includes a data latch unit 131, a decoder unit 132, an output unit 133C, and a failure inspection control unit 200C. The data latch unit 131 and the decoder unit 132 are the same as those shown in FIG. 2, and thus, explanations of operations thereof are omitted.

Similarly to the failure inspection control unit 200, the failure inspection control unit 200C generates the failure inspection control data SWC and the acquisition timing signals CLK1 and CLK2 and supplies the foregoing to the output unit 133C. However, the failure inspection control unit 200C supplies, to the display panel 20B via the external terminal TM, the single linking control signal SCa as the linking control signal that controls the source line linking switches SW71 to SW7*n* to be ON or OFF.

Similarly to the output unit 133, the output unit 133C is set to normal mode or failure inspection mode according to the failure inspection control data SWC and the acquisition timing signals CLK1 and CLK2 supplied from the failure inspection control unit 200C. During the normal mode, the output unit 133C supplies, as the output voltages GV1 to GVn, the n voltages attained by individually amplifying the drive voltages P1 to Pn supplied from the decoder unit 132, to the source lines S1 to Sn of the display panel 20B via external terminals t1 to tn. On the other hand, during the failure inspection mode, the output unit 133C performs failure inspection for detecting a failure such as a short-circuit between source lines, a disconnection or current leakage in the source lines, or the like, for the source lines S1 to Sn of the display panel 20B.

Figure 19:
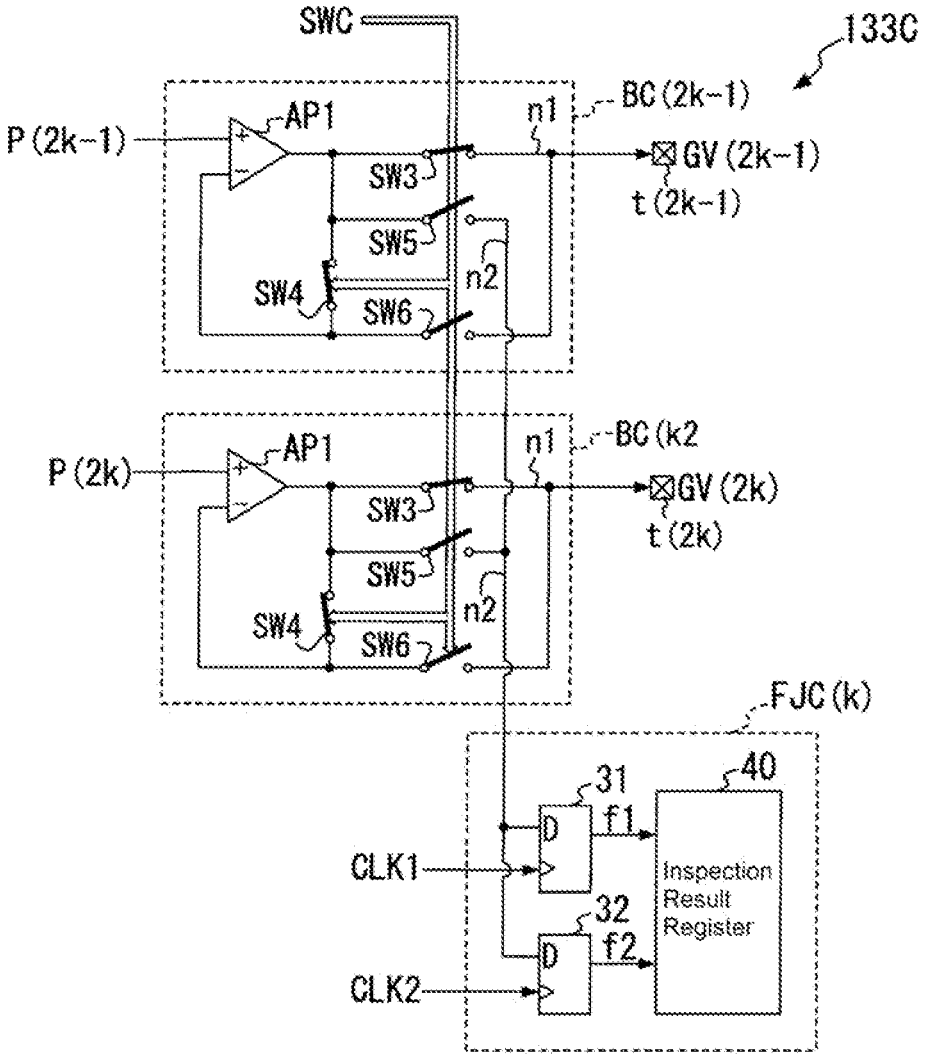
FIG. 19 is a circuit diagram showing an example of an internal configuration of an output unit 133C.

FIG. 19 is a circuit diagram showing the internal configuration of the output unit 133C.

The output unit 133C, similarly to the output unit 133, includes the output circuits BC1 to BCn shown in FIG. 3. However, as shown in FIG. 19, in the output unit 133C, one failure determination circuit FJC(k) is provided for each pair of output circuits constituted of a combination of an odd-numbered output circuit BC(2*k*−1) (k being an integer of 1 or greater) among the output circuits BC1 to BCn and an even-numbered output circuit BC(2*k*) adjacent thereto.

Similarly to the output unit 133, in the output unit 133C as well, control is performed according to the failure inspection control sequence (PER1, PER2) shown in FIG. 4 on the basis of the acquisition signal LOAD, the acquisition timing signals CLK1 and CLK2, the failure inspection control data SWC, and the drive voltages P1 to Pn.

In the reset step PER1 of the failure inspection sequence, the failure inspection control unit 200C sets all of the source line linking switches SW71 to SW7*n* to be OFF according to the linking control signal SCa. In the inspection step PER2, the failure inspection control unit 200C switches all of the source line linking switches SW71 to SW7*n* to be ON according to the linking control signal SCa.

Figure 20:
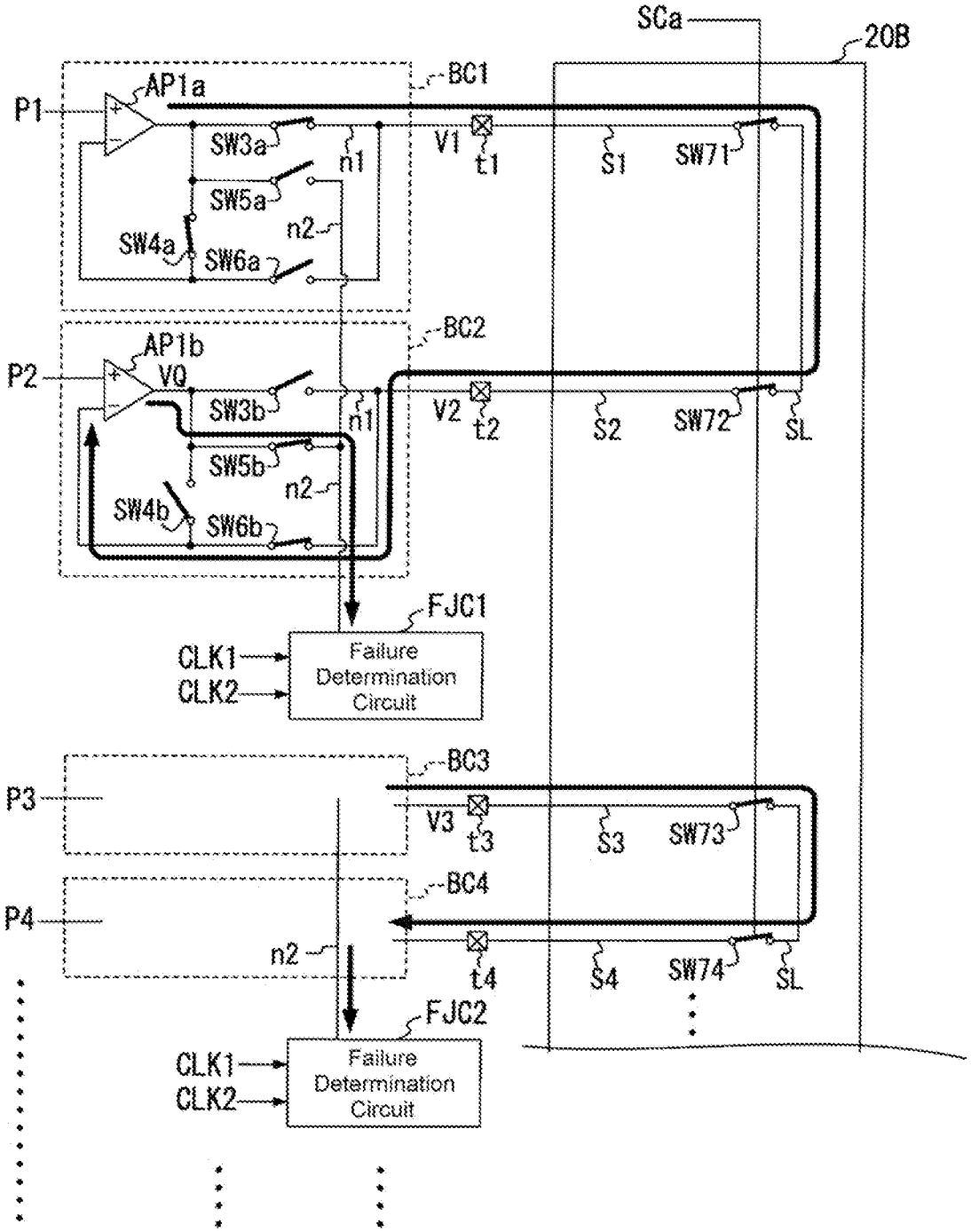
FIG. 20 is a circuit diagram showing, using bold arrows, the paths of currents flowing through the output unit 133C and a display panel 20B according to a test voltage during an inspection step PER2.

FIG. 20 is a circuit diagram showing, using bold arrows, the paths of currents flowing through the output unit 133C and the display panel 20B according to a test voltage during an inspection step PER2 of the failure inspection control sequence.

In FIG. 20, among the output circuits BC1 to BCn, the path of currents flowing through specifically BC1 and BC2 are shown. Additionally, in FIG. 20, the switches SW3 to SW6 of the output circuit BC1 are represented as SW3*a* to SW6*a*, and switches SW3 to SW6 of the output circuit BC2 are represented as SW3*b* to SW6*b*. Also, in FIG. 20, the operational amplifier AP1 included in the output circuit BC1 is represented as AP1*a* and the operational amplifier AP1 included in the output circuit BC2 is represented as AP1*b*.

As shown with the bold arrows of FIG. 20, during the inspection step PER2, the current outputted from the operational amplifier AP1*a* of the odd-numbered output circuit BC1 flows into the inversion input terminal of the operational amplifier AP1*b* of the output circuit BC2 via the switch SW3*a*, the node n1, the source line S1, the source line linking switches SW71 and SW72, the source line S2, and the node n1 and the switch SW6*b* of the even-numbered output circuit BC2.

As a result, a terminal voltage V1 corresponding to the voltage outputted from the output circuit BC1 is applied to the first end of the source line S1. Here, if there is no failure (disconnection, short-circuit, current leakage) in the source lines S1 and S2, then the parasitic capacitance on the source lines S1 and S2 causes the voltage value of the terminal voltage V2 of the output circuit BC2 to rise more gradually than the terminal voltage V1. The terminal voltage V2 is supplied to the inversion input terminal of the operational amplifier AP1*b* via the switch SW6*b* of the output circuit BC2. As a result, the operational amplifier AP1*b* of the output circuit BC2 outputs a current corresponding to the difference between the drive voltage P2 as the test voltage and the terminal voltage V2. Thus, the monitor voltage VQ that is the voltage of the output terminal of the operational amplifier AP1*b* of the output circuit BC2 rises. In the inspection step PER2, the monitor voltage VQ outputted from the operational amplifier AP1*b* of the output circuit BC2 is supplied to the D terminals of the FFs 31 and 32 of the failure determination circuit FJC1 via the monitor node n2.

In the output unit 133C, operations of the output circuits BC1 and BC2 described above are also simultaneously performed in the output circuits BC3 and BC4, the output circuits BC5 and BC6, . . . and the output circuits BC(n−1) and BCn. In the failure determination circuit FJC provided for each pair of output circuits, the failure determination described previously is performed, and the respective failure inspection results are stored.

Thus, in the display device 100C, the source line linking switches SW71 to SW7*n* disposed in the display panel 20B are controlled together to all be ON or OFF according to a single linking control signal SCa. As a result, it is possible to reduce the size of the display panel compared to the configuration of the display panel 20 of the display device 100 shown in FIG. 1 in which wiring lines are provided for transmitting n linking line control signals for controlling the source line linking switches SW71 to SW7*n* individually to be turned ON or OFF.

The output circuits BC1 to BCn and BC1A to BCnA of Embodiments 1 to 4 include the switches SW3 to SW6. However, regarding the output circuits BC1 to BCn in Embodiments 1 and 4, if the output circuit (hereinafter referred to as the test voltage output circuit) to supply a test voltage to the source line is fixed, then the switches SW3 to SW6 may be omitted from the test voltage output circuit. In this case, the operational amplifier AP1 included in the test voltage output circuit is a voltage follower in which the output terminal thereof is connected to the inversion input terminal thereof for both the normal mode and the failure inspection mode.

What is claimed is:

1. A display device, comprising:

a display panel that includes first to nth (n being an integer of 2 or greater) source lines, a linking line, and first to nth source line linking switches that are each connected to respective first ends of the first to nth source lines and that connect the first ends to the linking line when turned ON;

a decoder circuit that generates first to nth drive voltages having a voltage value based on an image signal during a normal mode, and generates n voltages having a test voltage as the first to nth drive voltages during a failure inspection mode;

first to nth output circuits that each include an operational amplifier that is configured to receive a drive voltage via a first input terminal and that has an output terminal connected to a second input terminal, and an output node connected to a second end of each of the source lines, the first to nth output circuits being configured to output, via the output nodes thereof respectively, voltages attained by individually amplifying the first to nth drive voltages in the operational amplifier as first to nth output voltages;

a failure inspection control circuit that, during the failure inspection mode, sets a source line linking switch, among the first to nth source line linking switches, that is connected to one source line and another source line among the first to nth source lines so as to be ON while setting OFF other source line linking switches, disconnects a connection between the output node and the output terminal of the operational amplifier included in another one of the output circuits connected to said another source line among one of the output circuits connected to the one source line and said another one of the output circuits, and connects the output node instead of the output terminal to the second input terminal of the operational amplifier; and a failure determination circuit that is configured to set a voltage of the output terminal of the operational amplifier included in said another one of the output circuits as a monitor voltage, to store, as a first failure determination signal, a signal attained by acquiring and binarizing the monitor voltage at a first timing, and to store, as a second failure determination signal, a signal attained by acquiring and binarizing the monitor voltage at a second timing delayed from the first timing by a prescribed delay time.

2. The display device according to claim 1, wherein the failure inspection mode includes a reset step of initializing an electric charge amount accumulated in each of the first to nth source lines, and wherein, during the reset step, the failure inspection control circuit performs control so as to connect the output terminal of the operational amplifier included in each of the first to nth output circuits to each of the output nodes and connect the second input terminal of the operational amplifier to each of the output nodes, and controls all of the first to nth source line linking switches so as to be OFF.

3. The display device according to claim 1, wherein the failure inspection control circuit sequentially changes a combination of a pair of output circuits constituted of said one of the output circuits and said another one of the output circuits among the first to nth output circuits during the failure inspection mode.

4. The display device according to claim 3, wherein the failure determination circuit is provided for each said pair of output circuits.

5. The display device according to claim 1, wherein, during the normal mode, the failure inspection control circuit connects the output terminal of the operational amplifier included in each of the first to nth output circuits to each of the output nodes, controls the second input terminal of the operational amplifier so as to be connected to each of the output nodes, and controls all of the first to nth source line linking switches so as to be OFF.

6. The display device according to claim 1, wherein each of the first to nth output circuits includes:

a first switch that connects the output terminal of the operational amplifier to the output node when turned ON;

a second switch that connects the output terminal of the operational amplifier to the second input terminal of the operational amplifier when turned ON;

a third switch that connects the output terminal of the operational amplifier to a monitor node when turned ON; and a fourth switch that connects the second input terminal of the operational amplifier to the output node when turned ON.

7. A display device, comprising:

a display panel including first to nth (n being an integer of 2 or greater) source lines;

a decoder circuit that generates first to nth drive voltages having a voltage value based on an image signal during a normal mode, and generates n voltages having a test voltage as the first to nth drive voltages during a failure inspection mode;

first to nth output circuits that each include an operational amplifier that is configured to receive a drive voltage via a first input terminal and that has an output terminal connected to a second input terminal, and an output node connected to each of the source lines, the first to nth output circuits being configured to output, via the output nodes thereof respectively, voltages attained by individually amplifying the first to nth drive voltages in the operational amplifier as first to nth output voltages;

a failure inspection control circuit that, during the failure inspection mode, disconnects a connection between the output node and the output terminal of the operational amplifier included in another one of the output circuits among one of the output circuits connected to one source line among the first to nth source lines and said another one of the output circuits connected to another source line, and connects the output node included in said one of the output circuits, instead of the output terminal, to the second input terminal of the operational amplifier; and a failure determination circuit that is configured to set a voltage of the output terminal of the operational amplifier included in said another one of the output circuits as a monitor voltage, to store, as a first failure determination signal, a signal attained by acquiring and binarizing the monitor voltage at a first timing, and to store, as a second failure determination signal, a signal attained by acquiring and binarizing the monitor voltage at a second timing delayed from the first timing by a prescribed delay time.

8. The display device according to claim 7, wherein the display device includes:

n external terminals respectively connected to a first end of each of the first to nth source lines; and first to nth output switches that connect the n external terminals to the output nodes of the first to nth output circuits, respectively, when turned ON.

9. The display device according to claim 7, wherein the failure inspection mode includes a reset step of initializing an electric charge amount accumulated in each of the first to nth source lines, and wherein, during the reset step, the failure inspection control circuit performs control so as to connect the output terminal of the operational amplifier included in each of the first to nth output circuits to the output node, and so as to connect the second input terminal of the operational amplifier to the output node.

10. The display device according to claim 7, wherein the failure inspection control circuit sequentially changes a combination of said one of the output circuits and said another one of the output circuits from among the first to nth output circuits during the failure inspection mode.

11. The display device according to claim 7, wherein, during the normal mode, the failure inspection control circuit performs control so as to connect the output terminal of the operational amplifier included in each of the first to nth output circuits to the output node, and so as to connect the second input terminal of the operational amplifier to the output node.

12. A display driver, comprising:

a decoder circuit that generates first to nth (n being an integer of 2 or greater) drive voltages having a voltage value based on an image signal during a normal mode, and that generates n voltages having a test voltage as the first to nth drive voltages during a failure inspection mode;

first to nth output circuits that each include an operational amplifier that is configured to receive a drive voltage via a first input terminal and that has an output terminal connected to a second input terminal, and an output node connected to an external terminal, the first to nth output circuits being configured to output, from n of the external terminals, voltages attained by individually amplifying the first to nth drive voltages in the operational amplifier as first to nth output voltages;

a failure inspection control circuit that, during the failure inspection mode, disconnects a connection between the output node and the output terminal of the operational amplifier included in another one of the output circuits among one of the output circuits connected to one external terminal among the n external terminals and said another one of the output circuits connected to another external terminal, and connects the output node included in said one of the output circuits, instead of the output terminal, to the second input terminal of the operational amplifier; and a failure determination circuit that is configured to set a voltage of the output terminal of the operational amplifier included in said another one of the output circuits as a monitor voltage, to store, as a first failure determination signal, a signal attained by acquiring and binarizing the monitor voltage at a first timing, and to store, as a second failure determination signal, a signal attained by acquiring and binarizing the monitor voltage at a second timing delayed from the first timing by a prescribed delay time.

13. A failure inspection method for a display panel in a display device including:

a display panel that includes first to nth (n being an integer of 2 or greater) source lines, a linking line, and first to nth source line linking switches that are each connected to respective second ends of the first to nth source lines and that connect the second ends to the linking line when turned ON;

first to nth output circuits that each include an operational amplifier that is configured to receive, at a first input terminal thereof, a drive voltage having a voltage value based on an image signal or a test voltage value for failure inspection, and an output node connected to a source line, the first to nth output circuits being configured to supply an output voltage outputted from the operational amplifier to the source line via the output node, wherein the failure inspection method comprises:

connecting an output terminal of the operational amplifier included in one output circuit among the first to nth output circuits to the output node and connecting a second input terminal of the operational amplifier to the output node;

disconnecting a connection between the output node and the output terminal of the operational amplifier included in another one of the output circuits differing from the one output circuit among the first to nth output circuits, and connecting the output node instead of the output terminal to the second input terminal of the operational amplifier;

setting a source line linking switch, among the first to nth source line linking switches, connected to each of a pair of the source lines connected to the output node of the one output circuit and said another one of the output circuits so as to be ON, and setting other source line linking switches to be OFF; and setting a voltage of the output terminal of the operational amplifier included in said another one of the output circuits as a monitor voltage and storing, as a first failure determination signal, a signal attained by acquiring and binarizing the monitor voltage at a first timing, and storing, as a second failure determination signal, a signal attained by acquiring and binarizing the monitor voltage at a second timing delayed from the first timing by a prescribed delay time.

14. A failure inspection method for a display panel in a display device including:

a display panel including first to nth (n being an integer of 2 or greater) source lines;

first to nth output circuits that each include an operational amplifier that is configured to receive, at a first input terminal thereof, a drive voltage having a voltage value based on an image signal or a test voltage value for failure inspection, and an output node connected to the source line, the first to nth output circuits being configured to supply an output voltage outputted from the operational amplifier to the source line via the output node, wherein the failure inspection method comprises:

connecting an output terminal of the operational amplifier included in one output circuit among the first to nth output circuits to the output node and connecting a second input terminal of the operational amplifier to the output node;

disconnecting a connection between the output node and the output terminal of the operational amplifier included in another one of the output circuits differing from the one output circuit among the first to nth output circuits, and connecting the output node of the first output circuit to the second input terminal of the operational amplifier; and setting a voltage of the output terminal of the operational amplifier included in said another one of the output circuits as a monitor voltage and storing, as a first failure determination signal, a signal attained by acquiring and binarizing the monitor voltage at a first timing, and storing, as a second failure determination signal, a signal attained by acquiring and binarizing the monitor voltage at a second timing delayed from the first timing by a prescribed delay time.

* * * * *